US006448498B1

(12) United States Patent
King et al.

(10) Patent No.: US 6,448,498 B1
(45) **Date of Patent: *Sep. 10, 2002**

(54) FLEXIBLE RACEWAY ARRANGEMENT FOR CABLING

(75) Inventors: Steven Jay King, Park Township, MI (US); Charles J. Saylor, Grand Rapids, MI (US); X. Shawn Yu, Hudsonville, MI (US); Clifford Wayne Nelson, Norton Shores, MI (US); Robert Clare Wayner, Holland, MI (US); Barry Lee Andersen, Park Township, MI (US); David E. Emery, Laketon Township, MI (US)

(73) Assignee: Haworth, Inc., Holland, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/562,165

(22) Filed: May 2, 2000

(51) Int. Cl.[7] ..... H02G 3/04

(52) U.S. Cl. ..... 174/99 R; 174/95; 174/100; 59/78.1; 108/50.02; 138/155

(58) Field of Search ..... 174/48, 68.3, 95, 174/96, 97, 99 R, 100, 101, 135, 72 A; 59/78.1, 900; 108/50.02; 138/120, 121, 155; 248/51

(56) References Cited

U.S. PATENT DOCUMENTS

| | | | |
|---|---|---|---|
| 2,140,685 | A | 12/1938 | Baxter |
| 2,241,309 | A | 5/1941 | Kovalik |
| 2,764,461 | A | 9/1956 | Montgomery |

(List continued on next page.)

FOREIGN PATENT DOCUMENTS

| | | | |
|---|---|---|---|
| DE | 1 590 188 | | 6/1970 |
| DE | 77 12 110 | | 8/1977 |
| DE | 81 09 512 | | 3/1981 |
| DE | 38 14 602 | | 11/1989 |
| EP | 232 212 | | 8/1987 |
| FR | 2 555 423 | | 5/1985 |
| GB | 2 219 061 | A | 11/1989 |
| GB | 2 279 002 | | 12/1994 |
| JP | 2-163545 | | 6/1990 |
| WO | WO 93/21799 | | 11/1993 |

OTHER PUBLICATIONS

The Profession: New Products, "Teamwork Kit–of–Parts", *Architectural Record*, May 1995, p. 46.

Hotline, Crossing Over to a New Work Style, *Facilities Design & Management*, May 1995, pp. 28–29.

Product Focus, "The Future Arrives—in 1995?", *Contract Design*, May 1995.

Plastic Support Chain for Cables and Conduit, Murrplastik, Nov./1986 (3 pages).

* cited by examiner

*Primary Examiner*—Dean A. Reichard
*Assistant Examiner*—Adolfo Nino
(74) *Attorney, Agent, or Firm*—Flynn, Thiel, Boutell & Tanis, P.C.

(57) ABSTRACT

A flexible raceway arrangement for routing power and/or communication cabling to a work area. The raceway arrangement includes an elongate support member which mounts thereon a plurality of raceway covers arranged along the support member in side-by-side relation with one another to define an elongate raceway run. The individual side covers are pivotably openable to provide access to cabling within the interior thereof.

41 Claims, 18 Drawing Sheets

U.S. PATENT DOCUMENTS 3,034,153 A 5/1962 Sargent
3,042,467 A 7/1962 Germick
3,053,358 A 9/1962 Gross
3,060,972 A * 10/1962 Sheldon ..... 138/155
3,193,341 A 7/1965 Preston
3,197,954 A 8/1965 Merker et al.
3,363,050 A 1/1968 Martin
3,664,619 A 5/1972 Heidrich et al.
4,066,306 A 1/1978 Klinder
4,104,871 A 8/1978 Moritz
4,133,153 A 1/1979 Hage
4,277,123 A 7/1981 Haworth et al.
4,323,291 A 4/1982 Ball
4,392,344 A 7/1983 Gordon et al.
4,396,797 A 8/1983 Sakuragi et al.
4,551,577 A 11/1985 Byrne
4,570,437 A 2/1986 Moritz
4,582,281 A 4/1986 Van Camp
4,602,124 A * 7/1986 Santucci ..... 174/101
4,626,233 A 12/1986 Moritz
4,648,733 A 3/1987 Merkt
4,654,756 A 3/1987 Wilson et al.
4,658,577 A 4/1987 Klein
4,672,805 A 6/1987 Moritz
4,683,695 A 8/1987 Galli
4,734,826 A 3/1988 Wilson et al.
4,769,199 A 9/1988 Bemis et al.
4,769,985 A 9/1988 Moritz
4,792,881 A 12/1988 Wilson et al.
4,800,714 A 1/1989 Moritz
4,807,432 A 2/1989 Mauri
4,827,850 A 5/1989 Diffrient
4,833,876 A 5/1989 Kitao et al.
4,834,069 A * 5/1989 Umeda ..... 138/120
4,840,023 A 6/1989 Borsani
4,852,342 A 8/1989 Hart
4,907,767 A * 3/1990 Corsi et al. ..... 174/97
4,948,205 A 8/1990 Kelley
4,974,620 A 12/1990 Quillan et al.
4,988,838 A 1/1991 Kirtland
5,016,841 A 5/1991 Schumann et al.
5,038,556 A 8/1991 Moritz et al.
5,065,556 A 11/1991 DeLong et al.
5,083,512 A 1/1992 Newhouse et al.
5,089,667 A * 2/1992 Goussin et al. ..... 174/101
5,092,253 A 3/1992 Grund et al.
5,103,741 A 4/1992 Grund et al.
5,108,350 A 4/1992 Szpakowski
5,121,698 A 6/1992 Kelley
5,157,913 A 10/1992 Wehler et al.
5,163,281 A 11/1992 Kanehira et al.
5,172,529 A 12/1992 Van De Riet
5,174,104 A 12/1992 Wehler et al.
5,231,562 A 7/1993 Pierce et al.
5,240,209 A 8/1993 Kutsch
5,272,988 A 12/1993 Kelley et al.
5,318,259 A 6/1994 Fussler
5,337,657 A 8/1994 Diffrient
5,428,928 A 7/1995 Hellwig et al.
5,516,298 A 5/1996 Smith
5,575,668 A 11/1996 Timmerman
5,642,612 A * 7/1997 Hughes ..... 58/78.1
RE35,579 E 8/1997 Moritz et al.
5,672,845 A 9/1997 Greenfield et al.
5,673,632 A 10/1997 Sykes
5,792,992 A * 8/1998 Handler ..... 174/101
5,800,027 A 9/1998 Dunn
5,809,900 A 9/1998 Alexander et al.
5,921,795 A 7/1999 Weener et al.
5,934,201 A 8/1999 Diffrient
5,971,508 A 10/1999 Deimen et al.
5,971,509 A * 10/1999 Deimen et al. ..... 108/50.02
5,988,076 A 11/1999 Vander Park
6,003,447 A 12/1999 Cox et al.
6,012,683 A 1/2000 Howell
6,017,228 A 1/2000 Verbeek et al.
6,023,024 A 2/2000 Stjerneby
6,202,567 B1 * 3/2001 Funk et al. ..... 108/50.02

FLEXIBLE RACEWAY ARRANGEMENT FOR CABLING

FIELD OF THE INVENTION

This invention relates to a workstation equipped with a power and telecommunication arrangement to define a work area and, more specifically, to an improved workstation which includes a console supported on a worksurface or table and housing one or more electrical power receptacles and/or communication receptacles. Further, the invention relates to an elongate and flexible raceway which provides an enclosed conduit for power and communication cabling, which raceway can be utilized to route cabling into and out of the console and is capable of distributing such cabling along a series of interconnected workstations.

BACKGROUND OF THE INVENTION

Commercial buildings typically include large open floor areas which are subdivided into a selected number of workstations or work areas, such as by space-dividing furniture components, for example portable wall panels. Each workstation is outfitted with additional furniture components such as storage cabinets, worksurfaces or the like which are either supported on the wall panels or are freestanding. Additionally, freestanding furniture components such as tables and desks may also be used to subdivide office areas into open workstation areas. Such furniture is commonly referred to as "systems" furniture, and is used extensively due to its flexibility in defining a wide variety of office configurations depending upon the specific requirements of an office area. Since these requirements can change over time, such systems furniture also can be reconfigured, for example, to change the arrangement, number and/or size of the workstations.

Such workstations typically include equipment and components which may require both electric power and communications connections. For example, workstations may include computers having modem connections, telephones, facsimile machines or the like, all of which require connection to separate power and communications circuits. The number and type of components may vary over time, or from one workstation to another.

With open office arrangements which are defined by freestanding furniture components placed in open areas to define various workstations for individual or team usage, providing power and communication cabling to these types of freestanding arrangements can be difficult and cumbersome. For example, power and communication cabling can be. provided to the workstation by running same over the floor, when then requires for safety reasons that the cabling be secured from movement and covered. Alternatively, cabling can be provided to this type of workstation through a fixed wall or through a raceway integrated into a portable wall panel. However, this type of arrangement can limit reconfiguration of the workstation, and can result in unsightly cabling in and around the workstation.

Accordingly, the present invention provides a workstation including a power and communication arrangement which enables the formation of one or multiple freestanding-type workstations within an open office space, which workstation or workstations include power and communication capabilities. More specifically, one or more worksurfaces are provided, and a console is mounted adjacent the rear edge of the respective worksurface. The console houses one or more electrical power receptacles and communication receptacles. The cabling associated with components supported on the worksurface which require connection to power and communication circuits is routed over the rear edge of the worksurface and into the console for connection to the appropriate power or communication receptacle provided therein. The console includes front and rear covers which serve to screen the contents therein and thus provide an uncluttered and neat appearance. Further, the covers are movable to provide easy access to the receptacles and cabling within the console.

The workstation arrangement according to the invention additionally includes an elongate raceway assembly which defines a conduit for distributing power and communication cables to individual workstations. Separate lengths of raceway segments are connectable to one another to create the desired raceway length depending upon the configuration of the work area, and terminal ends of a pair of raceway segments are respectively connectable to opposite sides of the console for communication with the interior thereof, and in one embodiment, serve to interconnect individual workstations to one another. In this regard, the raceway segments according to the invention are horizontally flexible and thus permit repositioning of the workstations relative to one another without the need for reconfiguration of the power and communication cabling.

A further aspect of the invention relates to a raceway assembly for handling power and/or communication cabling, the raceway assembly including an elongate and flexible spine or diaphragm which supports thereon pairs of opposed and openable side covers which together define a raceway link. A plurality of these links are supported along the spine in side-by-side relation to define an elongate raceway run. The spine serves to separate the interior of the raceway run into separate channels which may be used for routing power and/or communication cabling.

The terminal end of a raceway run is mountable to an infeed raceway assembly which carries power and communication cables from a ceiling, portable wall panel, fixed wall or other area. The infeed raceway assembly typically includes a raceway segment which is at least vertically flexible to allow multiple configurations of the entire raceway arrangement as dictated by the power and communication cabling routing with in the building.

The workstation arrangement according to the invention provides significant flexibility in the configuration of a work area, and specifically to an open-space work area. Further, power and communication circuits can be readily and safely routed to individual freestanding workstations from infeed areas without the need for reconfiguration of portable wall panels and/or the power and communication cabling carried therein.

Other objects and purposes of the invention, and variations thereof, will be apparent upon reading the following specification and inspecting the accompanying drawings.

Figure 1:
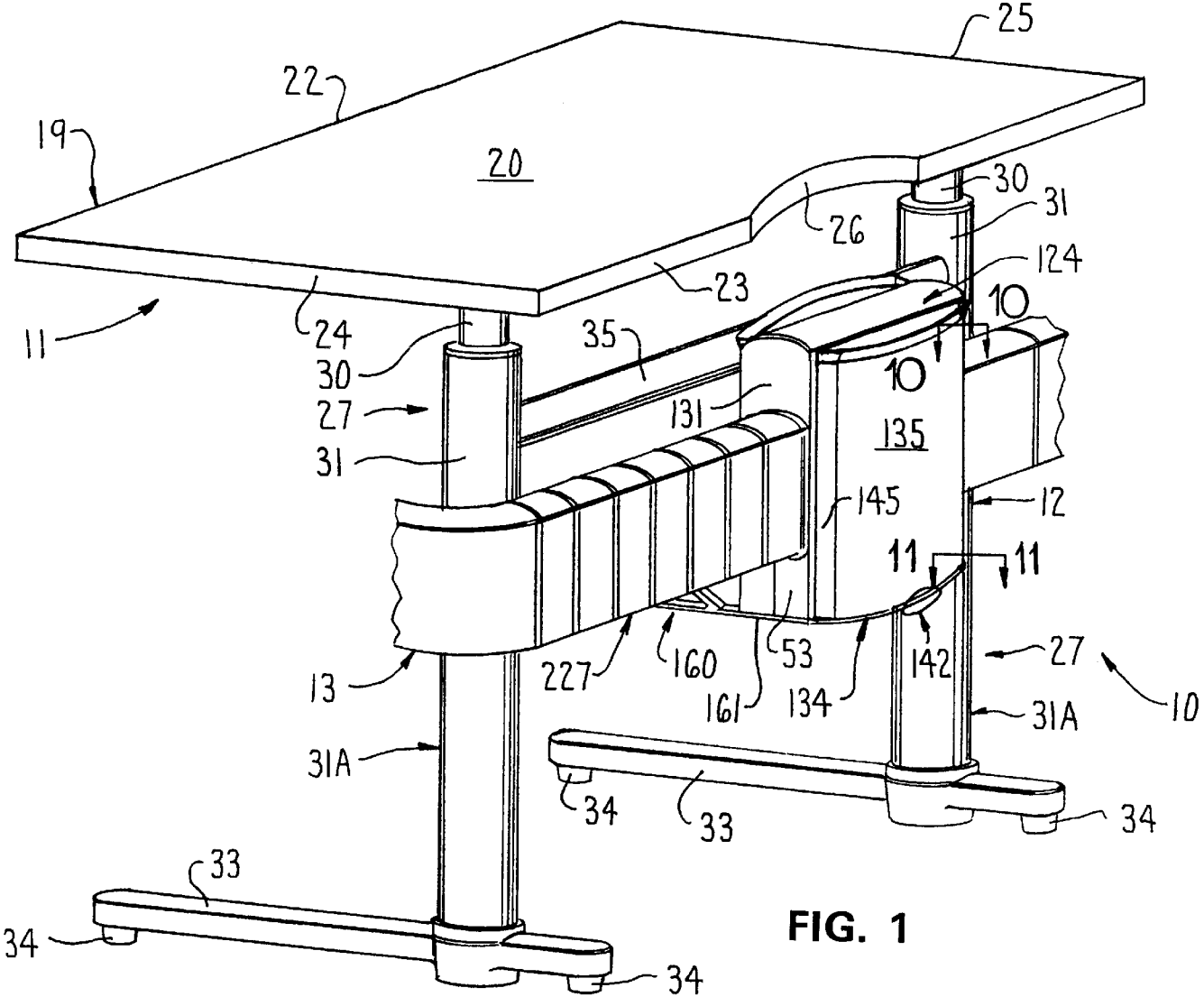
FIG. 1 is a fragmentary perspective view of the workstation according to the invention as viewed along a rear edge of the worksurface.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. The phrases "front edge" and "rear edge" in reference to the worksurface will respectively refer to the edge of the worksurface which is normally positioned closest to the user and the opposite edge which is normally positioned remotely from a user. Further, the terms "front" and "rear" when used in reference to the console will respectively refer to the side of the console which faces outwardly and away from the worksurface and the side which faces inwardly and toward the worksurface when the console is mounted thereon. Said terminology will include the words specifically mentioned, derivatives thereof, and words of similar import.

DETAILED DESCRIPTION

Figure 2:
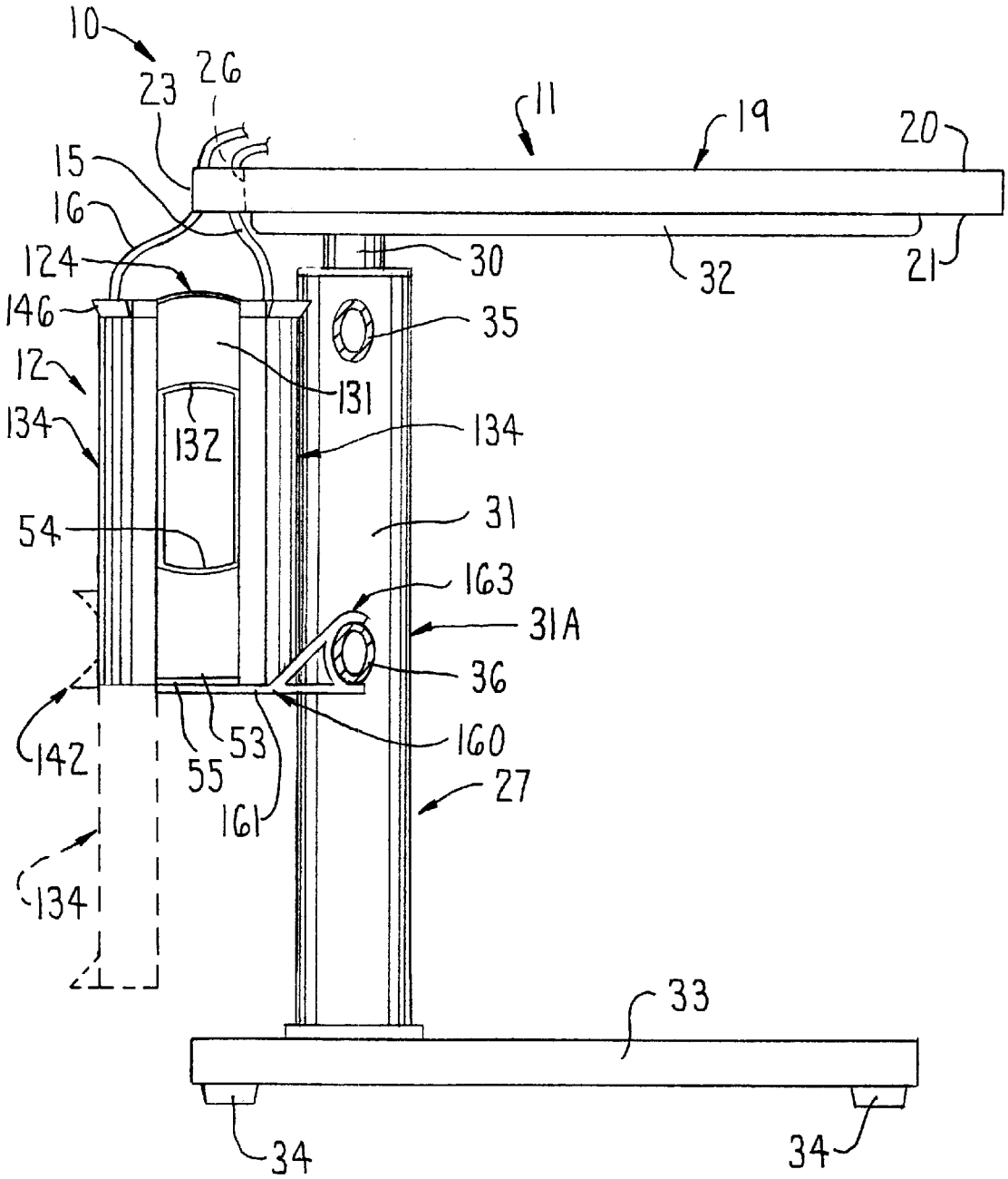
FIG. 2 is a partially-sectional side view of the workstation showing a lowered position of the front or outer screen in broken lines.
Figure 3:
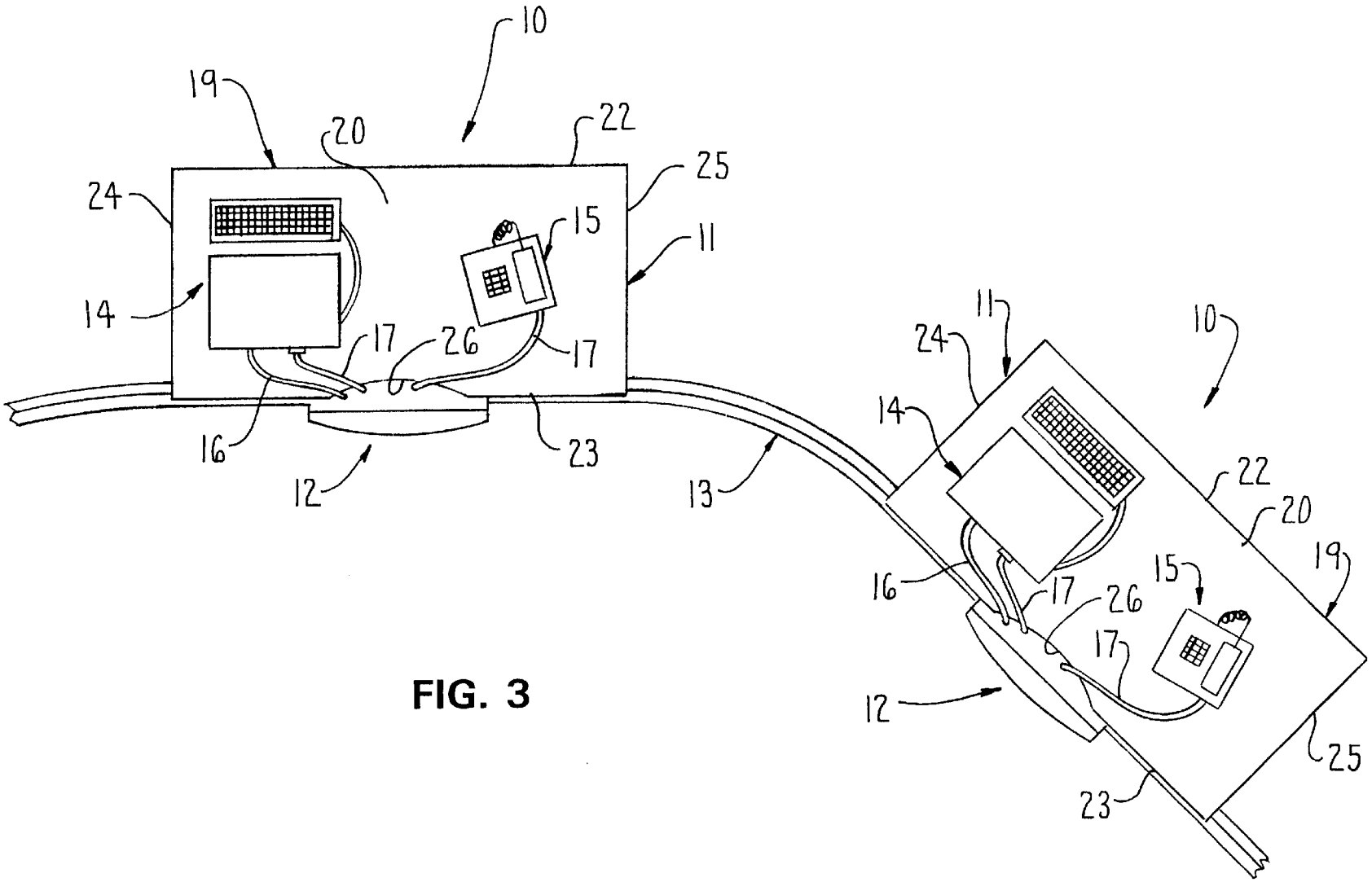
FIG. 3 is a plan view of a pair of adjacent interconnected workstations equipped with components requiring connection to power and communication circuits according to the invention.

The drawings and specifically FIGS. 1–4, illustrate a workstation 10 including a worksurface or table 11, an enclosed power and communication console 12 mounted on the worksurface 11, and a raceway assembly 13. As shown in FIG. 3, the workstation 10 may include equipment such as a computer and keyboard arrangement 14, and a telephone 15. The computer arrangement 14 necessarily includes a power cord 16 and the telephone 15 a phone line 17 as does the computer arrangement 14 if equipped with a modem.

The worksurface or table 11 includes a generally horizontally enlarged plate-like top 19 defining upper and lower surfaces 20 and 21 which are opposite one another and generally disposed so as to be substantially horizontal. The top 19 includes longitudinally extending front and rear edges 22 and 23, which in turn are joined together by respective end edges 24 and 25. In the illustrated embodiment, the rear edge 23 defines therein a shallow and generally arcuately-shaped recess 26 which permits routing of cabling, such as cord 16 and line 17 over rear edge 23 and into console 12 as discussed below.

The top 19 is supported in spaced relationship above a support surface, such as a floor, by a pair of leg assemblies 27 which are secured to the lower surface 21 of the top 19 and project downwardly therefrom. The individual leg assemblies 27 are horizontally spaced from one another and are respectively positioned adjacent the respective end edges 24 and 25 of the top 19. The leg assemblies 27 are substantially identical to one another and therefore only one of which will be described herein. The leg assembly 27 is defined by upper and lower leg sections 30 and 31 which together define a continuous and upright support 31A, and in the illustrated embodiment, the upper leg section 30 is telescopingly engaged within the tubular lower leg section 31 to enable vertical height adjustment of the top 19 relative to the support surface or floor into a plurality of positions. Such height adjustment mechanisms are known and will therefore not be discussed further herein. If desired, the worksurface 11 may also be equipped with an adjustment mechanism which permits angular adjustment of top 19 relative to the horizontal.

As shown in FIG. 2, the upper leg sections 30 are fixed to the lower surface 21 of top 19 via respective elongate and generally parallel mounting structures 32 which are secured to top 19 and extend generally along the respective end edges 24 and 25 in the front-to-rear (or transverse) direction of top 19. The lower end of lower leg sections 31 are connected to respective elongate and generally parallel supports or feet 33 which are positioned below the respective mounting structures 32, and also extend in the front to rear direction of the top 19. The mounting structures 32 and feet 33 have a length which is similar to the width of top 19 as measured in a front-to-back direction of top 19. The supports 33 each include a pair of glides 34 at opposite ends thereof which supportingly engage the floor. As best shown in FIG. 2, the mounting structures 32 and feet 33 position the legs 31A so that same are positioned closely adjacent the rear edge 23 of top 19 to provide the table 11 with a generally C-shaped configuration when viewed from the side.

Figure 4:
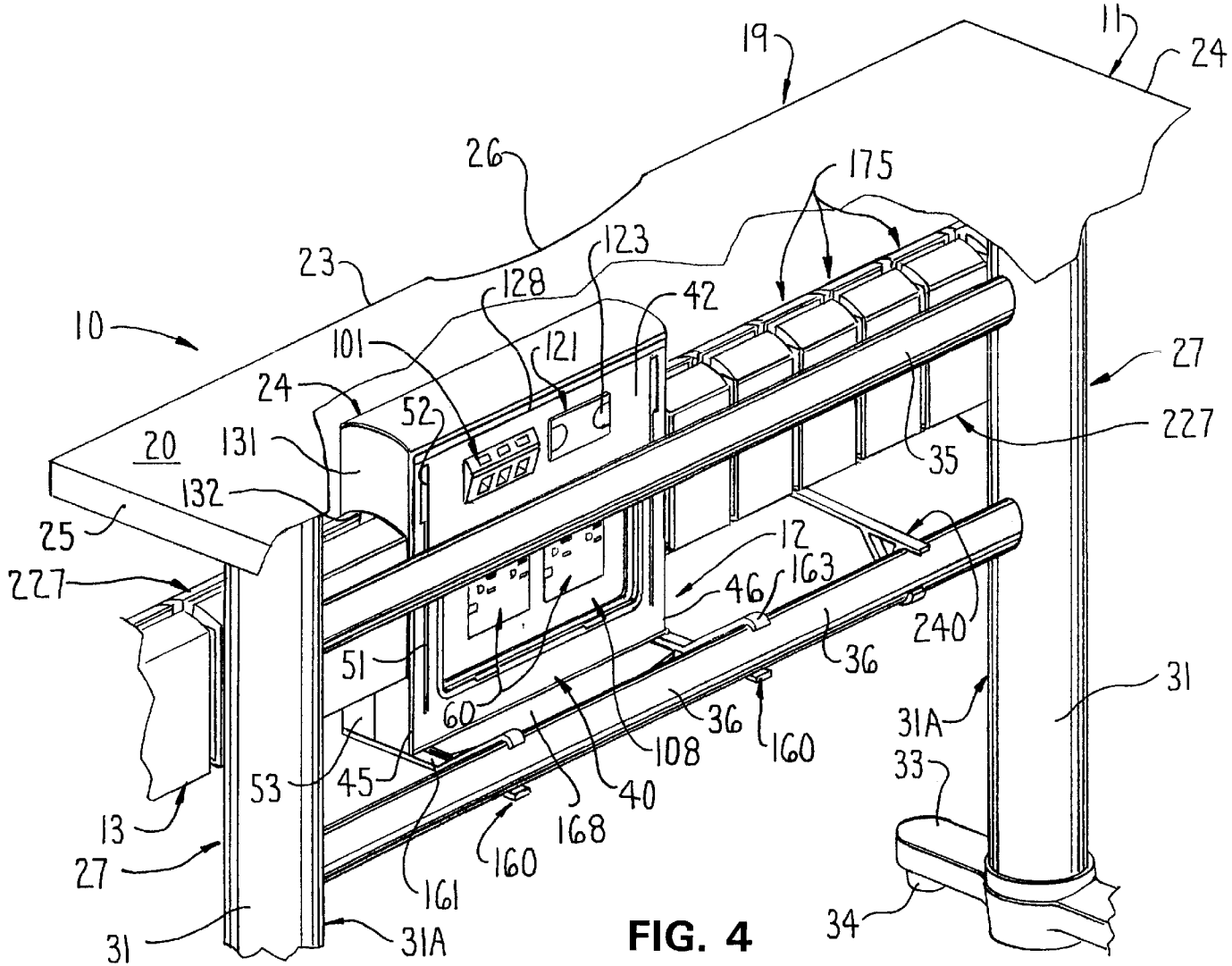
FIG. 4 is an enlarged, fragmentary view of the workstation illustrating the rear or inwardly facing side of the console and raceway with the screens removed from the console.

Referring to FIG. 4, table 11 is provided with upper and lower cross bars 35 and 36 which are vertically spaced from one another and extend transversely between supports 31A. The opposite ends of each cross bar 35 and 36 are fixed to the respective lower leg sections 31. In the illustrated embodiment, the upper cross bar 35 is spaced a short distance downwardly from lower surface 21 of top 19, and lower cross bar 36 is substantially parallel to and spaced downwardly from upper cross bar 35 so that cross bar 36 is disposed in a position which is about approximately half of the vertical height of the respective leg assemblies 27. The cross bars 35 and 36 provide worksurface 11 with a box-like, rigid frame.

Figure 5:
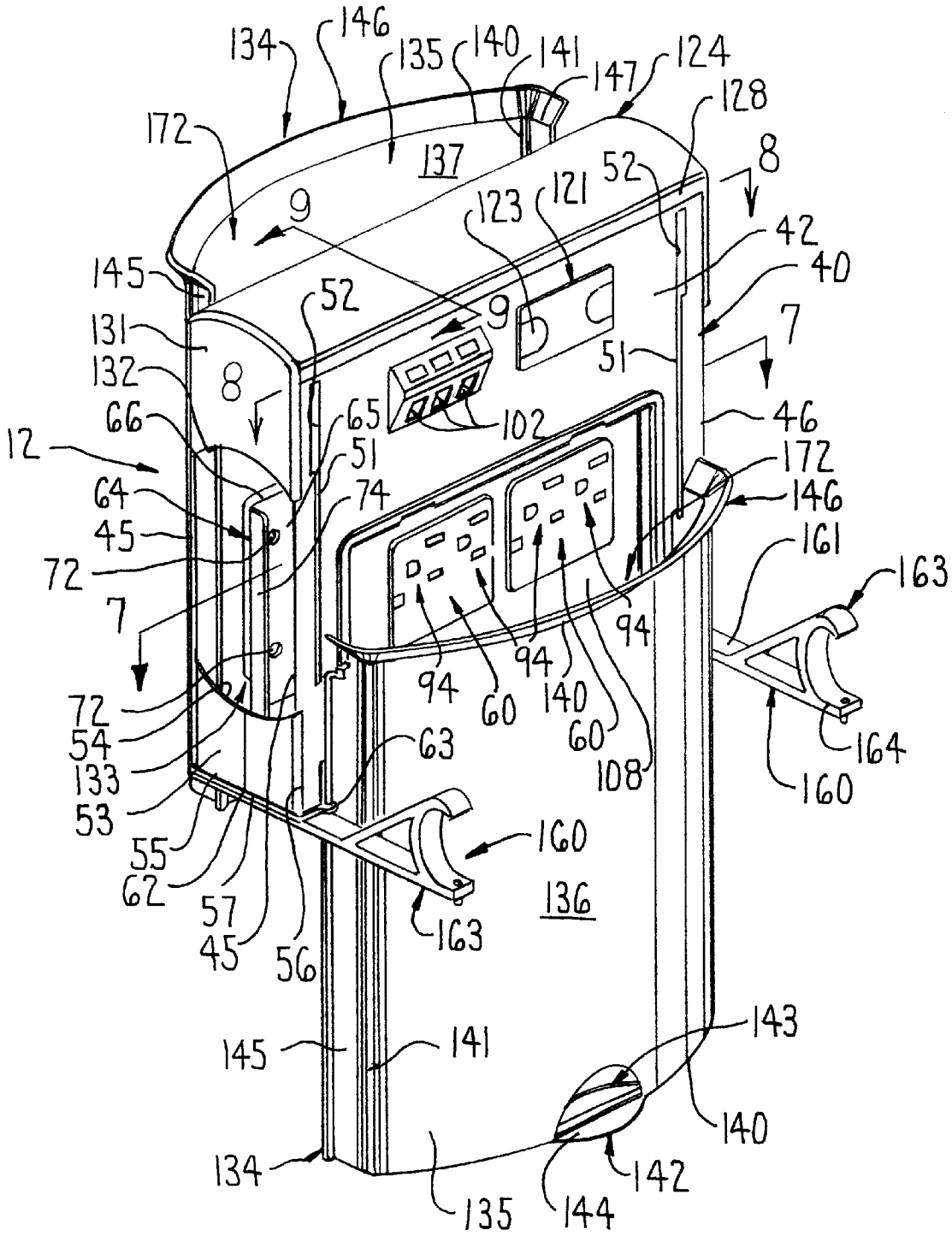
FIG. 5 is an enlarged view of the console with the rear or inner screen in a lowered position.
Figure 6A:
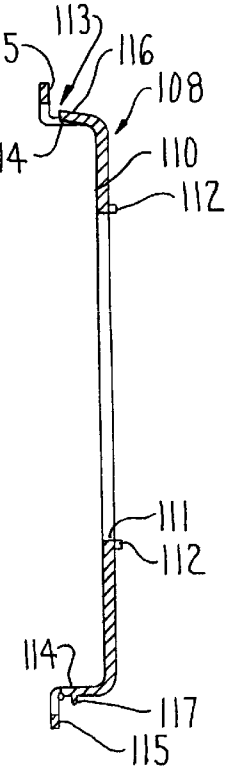
FIG. 6A is an enlarged cross-sectional view taken generally along line 6A—6A in FIG. 6.
Figure 6:
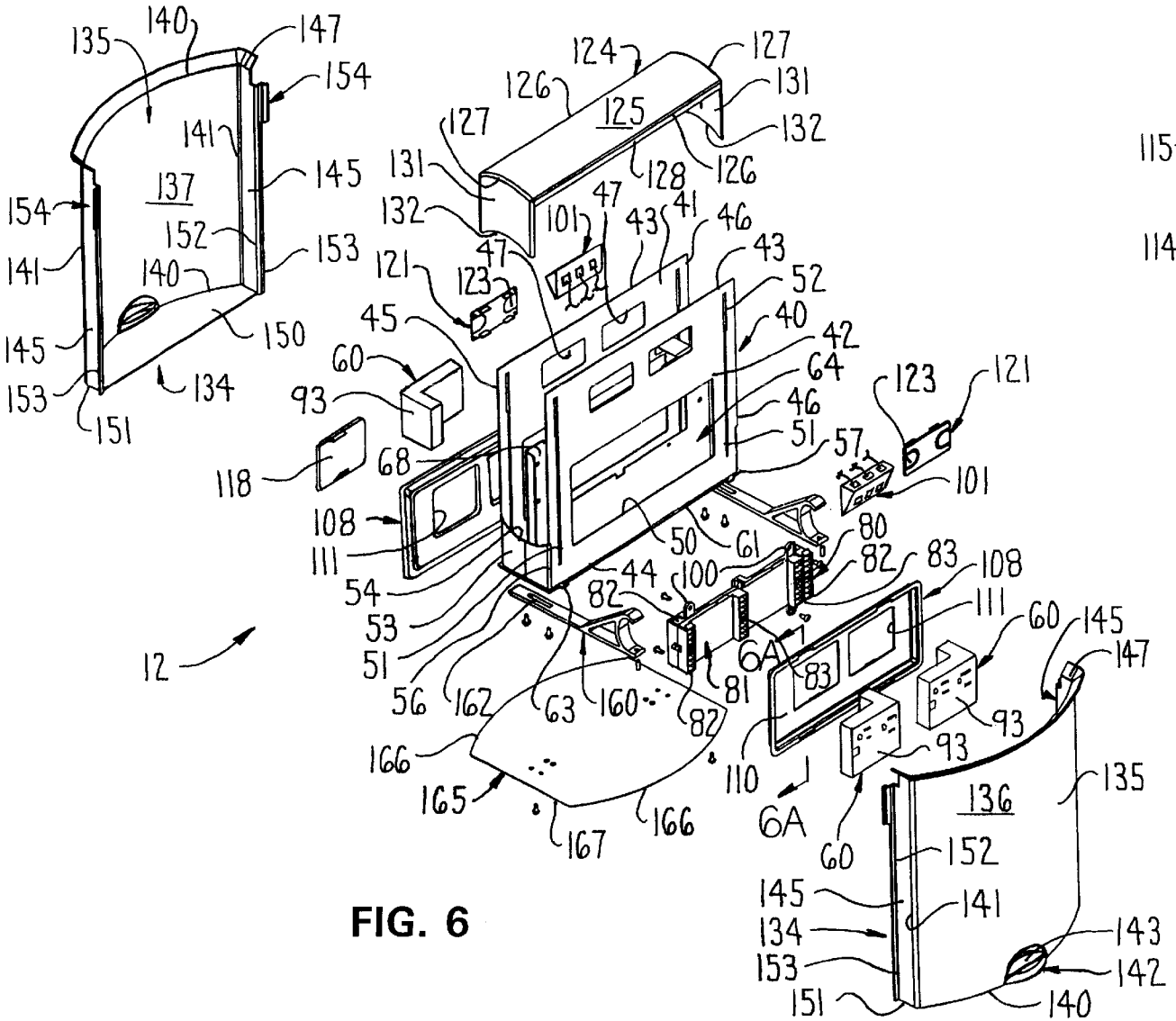
FIG. 6 is an exploded view of the console and the components thereof.
Figure 10:
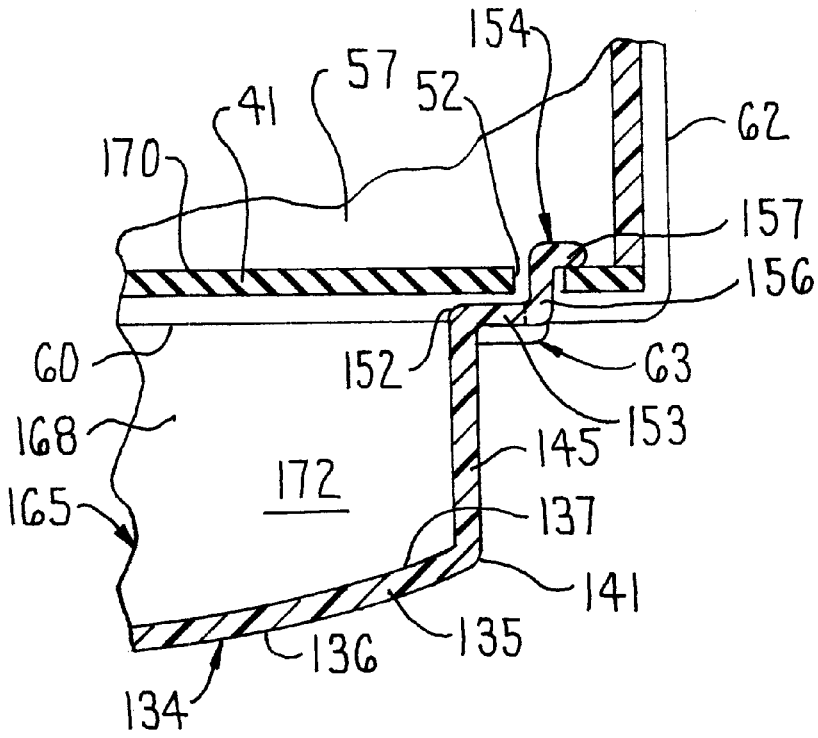
FIG. 10 is an enlarged, fragmentary cross-sectional view taken generally along line 10—10 in FIG. 1.

Turning now to console 12, and with reference to FIGS. 4–6, same includes a rigid frame 40, which in the illustrated embodiment is constructed of metal. The frame 40 is defined by generally upright and substantially parallel planar front and rear walls 41 and 42 which are horizontally spaced from one another. The front and rear walls 41 and 42 are identical to one another and are generally rectangular in shape as defined by upper and lower horizontal edges 43 and 44 which are in turn joined to one another via respective vertical edges 45 and 46. Each wall 41 and 42 defines therein a pair of horizontally elongate and rectangular openings or mounting holes 47 which are sidewardly spaced from one another along the respective wall and spaced inwardly from the respective side edges 45 and 46. A horizontally elongate and rectangular opening or mounting hole 50 is defined in each wall 41 and 42 and is spaced downwardly from the respective upper mounting holes 47. Lower mounting hole 50 extends across a substantial horizontal extent of the respective wall 41, 42, and terminates a short distance inwardly from the respective side edges 45 and 46 thereof. A pair of vertically elongate slots 51 are defined along the respective edges 45 and 46 of each wall 41, 42 and extend transversely between, but terminate short of, the upper and lower edges 43 and 44. As shown in FIGS. 5, 6 and 10, each slot 51 defines an enlarged area 52 at the uppermost extent thereof which has a width dimension (defined parallel to the upper edge 43) which is approximately twice as large as the width dimension of the lower portion of the respective slot 51.

Frame 40 additionally includes a pair of vertically short and identical end walls 53 which extend transversely between the respective front and rear walls 41 and 42. Each end wall 53 is defined by an uppermost edge 54 which has a shallow concave or arcuate configuration and a straight lowermost edge 55. The edges 54 and 55 are joined to one another via upright side edge portions 56 which in the illustrated embodiment are bent so as to engage within corresponding insets or recesses defined in the respective side edges 45 and 46 of walls 41 and 42. Frame 40 further includes a bottom plate-like and rectangular wall 57 (FIG. 9) defining an upper surface 58 upon which the front and rear walls 41 and 42 and the end walls 53 are positioned so as to provide frame 40 with a box-like shape. The bottom wall 57 is fixed to the other frame members via welding, or alternatively, via appropriate fasteners. The bottom wall 57 is defined by a pair of front and rear edges 60 and 61 which are joined to one another via respective side or end edges 62. Each front and rear edge 60, 61 includes a pair of hook-shaped guide members 63 (FIGS. 10 and 11) which project toward one another and are positioned adjacent the respective end edges 62 of bottom wall 57. Each guide member 63 defines a recess or notch 63A.

Figure 7:
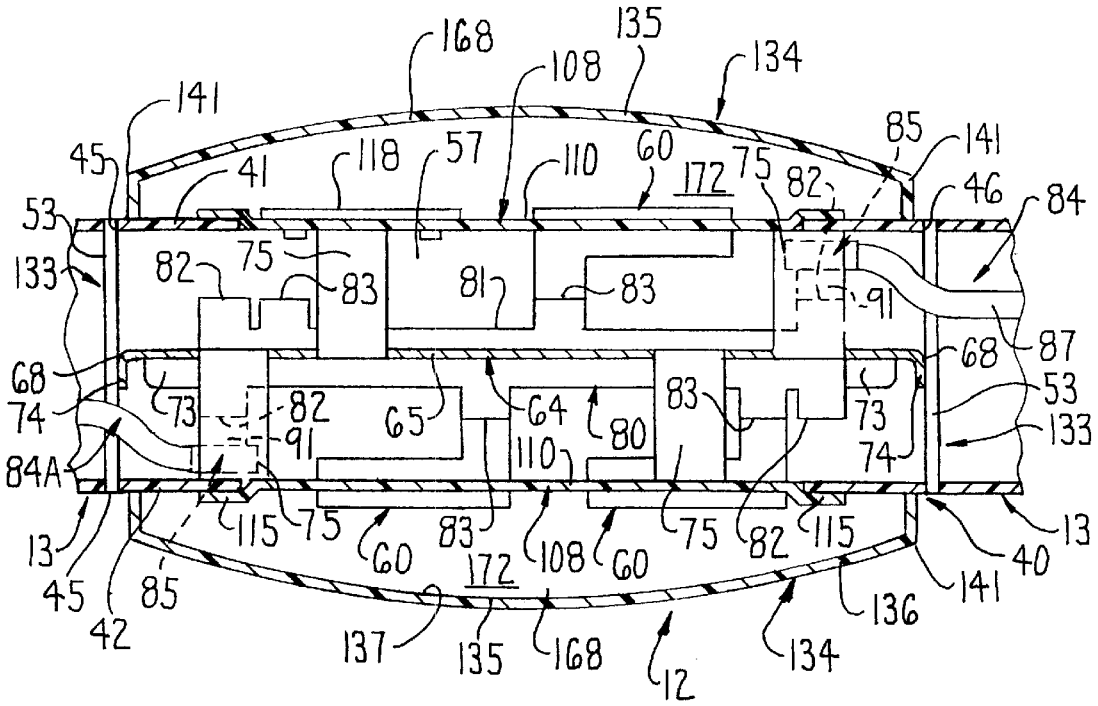
FIG. 7 is an enlarged cross-sectional view of the console. taken generally along line 7—7 in FIG. 5.
Figure 8:
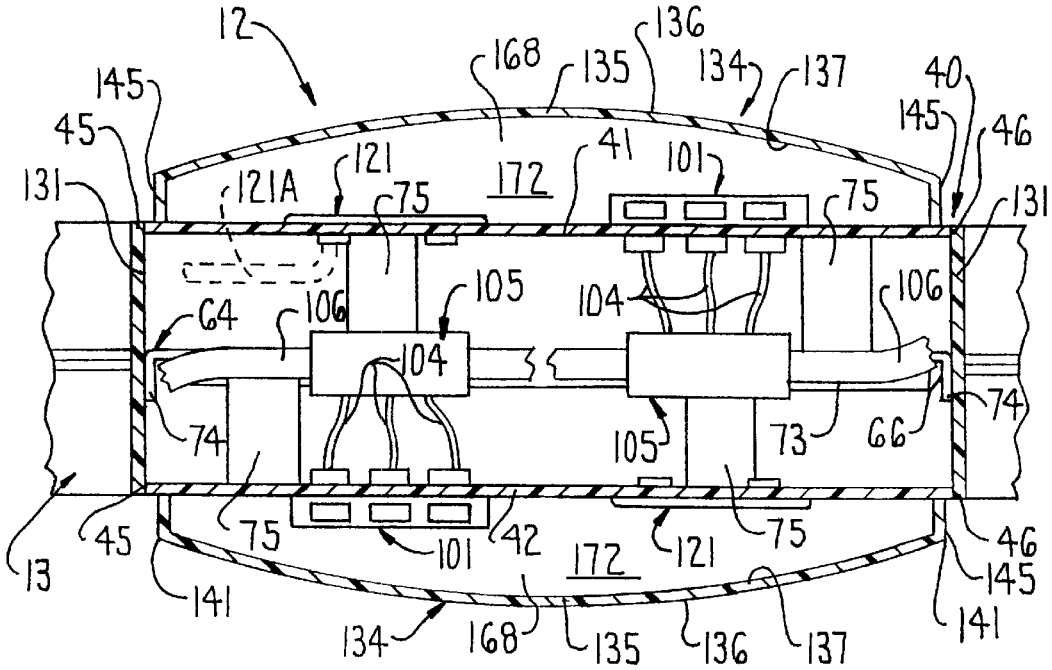
FIG. 8 is an enlarged cross-sectional view of the console taken generally along line 8—8 in FIG. 5.
Figure 9:
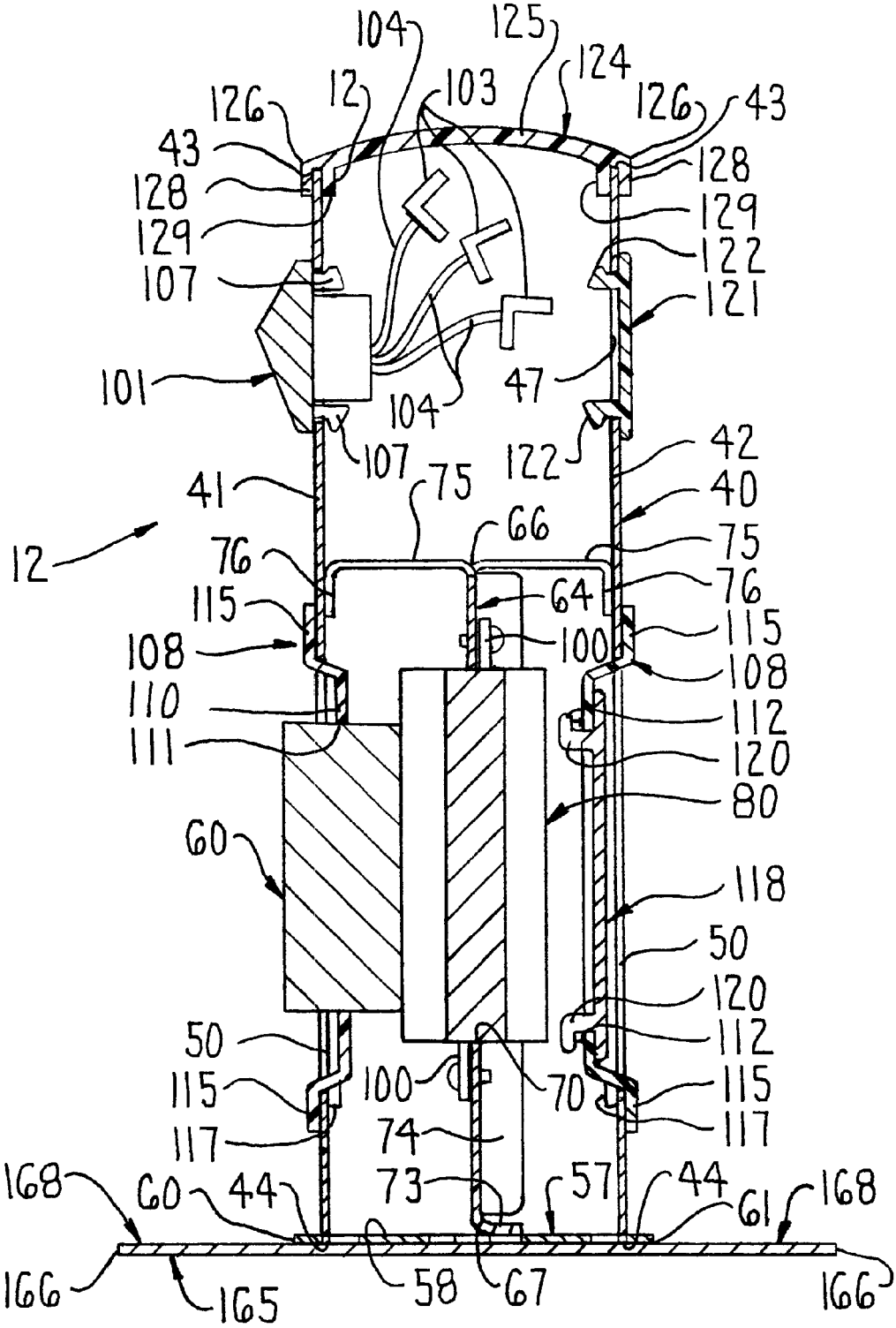
FIG. 9 is an enlarged cross-sectional view of the console taken generally along line 9—9 in FIG. 5.

With reference to FIGS. 6 and 9, frame 40 further includes a center plate or support 64 which extends transversely between end walls 53 and projects vertically upwardly from bottom wall 57 so that same is horizontally spaced from each of front and rear walls 41 and 42 by approximately the same distance. Center plate 64 is defined by a vertical and planar wall or panel 65 defined by generally parallel upper and lower edges 66 and 67 joined through a pair of upright side edges 68 (FIGS. 7–9). Panel 65 defines therein a horizontally elongate and generally rectangular opening 70, and a plurality of mounting holes extend through panel 65 and are positioned peripherally about opening 70 for a purpose discussed further below. Further, an additional pair of mounting holes 72 (only one pair of which are illustrated in FIGS. 5 and 6) are disposed vertically along each side edge 68 of panel 65 which are vertically spaced from one another.

Panel 65 additionally includes a bottom flange 73 which is joined to and projects generally horizontally from lower edge 67 and is fixed to upper surface 58 of bottom wall 57 via welding or fasteners. A pair of side flanges 74 are joined to and are cantilevered rearwardly from the respective side edges 68 of panel 65. The lengthwise extent of center plate 64 including side flanges 74 is slightly less than the transverse distance defined between end walls 53 so that the lower portions of side flanges 74 are superimposed on the inner surfaces of the end walls 53 and are fixed thereat via welding or fasteners. As shown in FIGS. 7 and 9, panel 65 also includes a plurality, and here four, of braces or tabs 75 which are joined to and project sidewardly from upper edge 66 in a cantilevered fashion. The terminal end of each brace 75 is defined by a downwardly depending flange 76, and a pair of the braces 75 project forwardly so that the respective flanges 76 thereof engage with the inwardly facing surface of front wall 41. Likewise, the other pair of braces 75 project rearwardly for engagement with the inwardly facing surface of rear wall 42. The flanges 76 may be fixed to the respective wall 41, 42 by welding or fasteners, or may abut the inner surface of the respective wall without a positive connection thereto to provide support in the transverse direction of frame 40. It will be appreciated that a greater or lesser number of braces 75 may be provided than that described here.

In the illustrated embodiment, center plate 64 may be formed from a single sheet of metal having appropriate cut-outs to define bottom flange 73, side flanges 74, and braces 75, and these components may then be bent relative to panel 65 as shown to form a unitary member.

Referring to FIGS. 6, 7 and 9, a power block or terminal 80 is mounted on center plate 64 and includes a block-like housing 81 and a pair of identical connector portions 82 project and face outwardly from each side of the block 80. Additional pairs of identical connector portions 83 project outwardly from each side of block 80, and the pair of connector portions 83 on one side of block 80 are longitudinally staggered or offset relative to the connector portions 83 on the opposite side of block 80. To electrically interconnect adjacent workstations 10 as discussed further below, the power blocks 80 of a pair of consoles 12 of two adjacent workstations 10 are electrically joined by a flexible elongate electrical connector 84. Each connector includes a pair of rigid insulative housing parts 85 at opposite ends thereof (only one of which is shown in FIG. 7) which are joined together by an intermediate flexible hinge portion 87, the latter being effectively formed as a substantially flat but flexible strap which can be readily hinged in a horizontal plane. A plurality of electrical wires extend through the hinge portion 87 and terminate in a corresponding number of conductive contacts (not shown) which project sidewardly. The contacts define a plug-in connector portion 91 which is designed to plug into the connector portions 82 of power block 80.

Referring to FIG. 6, one or more power tap units 92 are provided, specifically receptacle units, which can be plugged into one or both sides of the power block 80. The receptacle unit 92 includes a block-like housing 93 having at least one outlet portion 94 formed in a front wall 95 thereof. The outlet portion 94 includes one or more conventional three-hole outlets or socket-type receptacles. While the receptacle unit 92 is illustrated in a configuration consistent with standards utilized throughout the United States, it will be recognized that the receptacle unit 92 could also have a configuration corresponding to the standard receptacle utilized in foreign countries such as the European countries. The receptacle units 92 each include appropriately configured connector portions (not shown) which project rearwardly therefrom for creating a plug-in electrical connection with a connector portion 83 located on one side of the power block 80. The power block 80, flexible connectors 84 and plug-in receptacle units 92 are discussed in detail in U.S. Pat. No. 4,781,609 which is hereby incorporated by reference in its entirety, and will therefore not be described in further detail herein. The electrical system described above is a commercially available system sold by the Assignee hereof known as the "Power Base System".

The power block 80 mounts thereon pairs of upper and lower mounting flanges or tabs 100 adjacent opposite ends thereof which are utilized along with fasteners to secure the power block 80 within the opening 70 of center plate 64 as shown in FIG. 9.

With continued reference to FIGS. 6, 8 and 9, one or more telephone jack units 101 are mounted to frame 40. Each jack unit 101 houses one or more, and here three, jacks 102 (FIG. 5) each of which defines an outlet or port to which communication equipment such as telephone 15 and computer 14 can be connected. Each jack 102 is connected to a plug-like tap 103 via a tap cable 104, and taps 103 can be inserted into a selected one of the access ports (not shown) defined by a pair of connector units 105 which define the respective ends of a serially connected pair of modular communication distribution assemblies (CDA) 106 routed through the raceway assembly 13. These paired connector units together define a connector head 105. The jack units 101 are mounted within the openings 47 of the respective front or rear wall 41, 42 of frame 40 via spring tabs 107. The jack units 101, taps 103, tap cables 104, connector heads 105 and CDAs 106 are discussed in detail in U.S. patent application Ser. No. 09/067,070 entitled "TELECOMMUNICATIONS CABLING ARRANGEMENT" which is hereby incorporated by reference in its entirety. The cabling arrangement disclosed in the '070 application is commercially available under the trademark "DATATHING".

Referring to FIGS. 6, 6A and 9, frame 40 mounts thereon a pair of face plates or bezels 108 within the respective mounting holes 50 of front and rear walls 41 and 42. The bezels 108 are identical to one another and therefore only one of same will be described. Bezel 108 includes a generally rectangular and upright center wall 110 which defines therein a pair of rectangular openings or ports 111. Upper and lower cover mounting flanges 112 project horizontally from the inwardly facing surface of center wall 110 and respectively extend along the upper and lower horizontal terminal edges of center wall 110 which define the upper and lower extent of each opening 111.

The outer peripheral edge of center wall 110 is joined to and bordered by an outer peripheral wall 113 defined by an inner generally horizontally extending and ring-like flange 114 when is then bent upwardly so as to define a ring-like front face wall 115 which is generally vertically oriented. At the corner junction of the flange 114 and front face wall 115 and along the upper extensions thereof, a pair of semi-rectangular openings are cut out so as to define a pair of detents or spring tabs 116 adjacent opposite transverse sides of the bezel 108. A pair of downwardly projecting ribs or tabs 117 are defined along the lower extension of flange 114 slightly behind the junction with front face wall 115. The lower tabs 117 are horizontally spaced from one another and are vertically aligned with the respective upper spring tabs 116.

The bezels 108 are installed on the front and rear walls 41 and 42 of frame 40 as follows. Bezel 108 is positioned so that the lower part of center wall 110 projects into the mounting hole 50 and the edge of front wall 41 which defines the lower longitudinal extent of mounting hole 50 is engaged between the front face wall 115 and the respective ribs 117. The bezel 108 is then pivoted upwardly and the upper part thereof is pushed into mounting hole 50 which eventually causes the spring tabs 116 to deflect downwardly and once the tabs 116 clear the edge of front wall 41 which defines the upper longitudinal extent of hole 50, then the spring tabs 116 return to their former position and snap behind front wall 41 and engage a rear surface thereof to lock the bezel 108 within mounting hole 50. The bezel 108 can then be removed from wall 41 by pushing downwardly on the spring tabs 116 to release same from front wall 41. The opposite bezel 108 is installed in the same manner on rear wall 42. When the bezel 108 is installed on frame 40, the openings 111 thereof are aligned with the mounting holes 50 of the respective front and rear walls 41 and,42.

As shown in FIGS. 6 and 9, once the bezels 108 are installed on frame 40, the receptacle unit 92 can be connected with the power block 80 by inserting unit 92 into either opening 111 of bezel 108 and plugging same into the appropriate connector portion 83 of power block 80. Additional receptacle units 92 may be plugged into power block 80 through openings 111 of either bezel 108 as desired. The console 12 in the illustrated embodiment is configured to mount a maximum of four receptacle units 92 therein, however, a greater or lesser number of units 92 may be desirable. For example, when a lesser number of receptacle units 92 is desirable, a cover plate 118 may be provided so as to close off the unused receptacle opening 111 defined in bezel 108. The cover plate 118 is mounted within the opening 111 via spring-tabs 120 which engage around the upper and lower edges of the center wall 110 which respectively define the upper and lower extents of the opening 111.

Similarly, the console 12 in the illustrated embodiment is adapted to mount a maximum of four jack units 101, however a greater or lesser number may be desirable. In this regard, when a lesser number of jack units 101 is desirable, then a cover plate 121 can be mounted within the corresponding mounting hole 47. The cover plate 121 is mounted within a mounting hole 47 via spring tabs 122 which engage around the upper and lower edges of the corresponding front or rear wall 41, 42 which respectively define the upper and lower extents of the corresponding mounting hole 47. Further, the cover plate 121 can include one or more break-out sections 123. In this regard, the arrangement according to the invention may be utilized with the communication arrangement disclosed in the '070 application as mentioned above. Alternatively, one or both of the break-out sections 123 of the cover plate 121 can be removed so as to define a port or ports and a conventional telephone line 121A (shown in dotted lines in FIG. 8) may be routed through the raceway assembly 13, into the console 12, and then through the respective port for connection to various components supported on the worksurface 11. It is also possible to utilize a standard telephone jack in place of the jack unit 101 discussed above, which jack would then be appropriately connected to a telephone line routed within raceway assembly 13.

Console 12 additionally includes a top cover 124 which extends longitudinally between front and rear walls 41 and 42 of frame 40, and transversely between end walls 53 thereof. Cover 124 is defined by an uppermost wall 125 which has a generally upwardly projecting convex or arcuate configuration when viewed from one end thereof, and is defined by a pair of longitudinal and parallel edges 126 joined together by a pair of end edges 127. A vertically short flange 128 projects downwardly from each longitudinal edge 126 and extends along the entire extent thereof. As shown in FIG. 9, a plurality of guides or ribs 129 project downwardly from a lower surface of uppermost wall 125 adjacent each flange 128. Each rib 129 is parallel to and spaced slightly horizontally inwardly from the respective flange 128 so that a horizontally extending channel is defined therebetween.

Cover 124 also includes a pair of end walls 131 which are joined to and are cantilevered downwardly from the opposite end edges 127 of uppermost wall 125. Each end wall 131 defines a lowermost free edge 132 which is upwardly arcuate or concave and reversed as compared to the upper edges 54 of end walls 53.

Cover 124 is installed on the frame 40 by lowering same relative to frame 40 and horizontally aligning the upper edges 43 of the respective front and rear walls 41 and 42 with the corresponding channels defined between the ribs 129 and the adjacent flanges 128 of uppermost wall 125. The cover 124 is lowered relative to frame 40 until the edges 43 seat within the respective channels. In the installed position of the cover 124, the lower edges 132 of the respective end walls 131 are opposed to and vertically spaced from the upper edges 54 of the corresponding end walls 53 of frame 40 so as to define a sidewardly opening raceway port 133.

A pair of side covers or screens 134 are mounted on the respective front and rear faces of frame 40. Screens 134 are identical to one another and therefore only one screen will be described. Screen 134 includes a main upright wall 135 defining oppositely facing outer and inner surfaces 136 and 137, upper and lower horizontal and parallel edges 140, and upright vertical edges 141 which extend between and adjoin upper and lower edges 140. Main wall 135 has a convex or arcuately curved and outwardly projecting configuration in the illustrated embodiment. A handle or gripping member 142 is provided on main wall 135 adjacent the lower edge 140 thereof which projects horizontally outwardly beyond outer surface 136. Further, a recess 143 is provided in main wall 135 above handle 142 so as to define a gripping area 144, for example, in which the thumb can be placed while positioning the index finger beneath the handle 142 to manipulate screen 134.

Screen 134 also includes a pair of side walls 145 which are substantially parallel to one another and are joined to and project outwardly from the respective vertical edges 141 of main wall 135. A lip or flange 146 which is generally U-shaped when viewed from above extends along and interconnects uppermost edges 147 of the respective side walls 145 and upper edge 140 of main wall 135. As shown in FIG. 2, lip 146 angles or diverges outwardly as same projects upwardly from edges 147 and 140 of the main and side walls. In the illustrated embodiment, lip 146 is oriented at an angle of approximately 45 degrees relative to the horizontal.

Screen 134 is additionally provided with a planar bottom wall 150 (FIG. 6) which extends transversely between the main and side walls 135 and 145 and is adjoined to and interconnects the lower edges 140 and 151 thereof.

Figure 11:
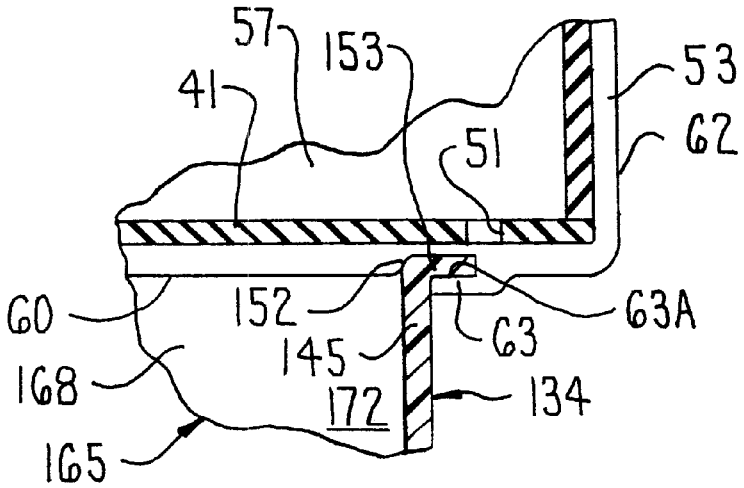
FIG. 11 is an enlarged, fragmentary cross-sectional view taken generally along line 11—11 in FIG. 1.

As shown in FIGS. 6, 10 and 11, the free vertical edges 152 of side walls 145 are joined to a sidewardly extending flange 153 which extends along the entire vertical extent of the respective side wall 145. In the illustrated embodiment, flange 153 is oriented substantially perpendicularly relative to the respective side wall 145, and has a width which is approximately ⅓ of the width of side wall 145. A pair of mounting members 154 are provided at the upper ends of the respective flanges 153. Mounting members 154, as shown in FIG. 10 are corner-shaped and are defined by a first leg 156 which is perpendicular relative to the respective flange 153 and at one edge is joined to a vertical edge thereof, and a second leg 157 which is perpendicular relative to the first leg 156 and is joined to the opposite edge thereof.

Referring to FIG. 6, a pair of rigid support arms or brackets 160 are provided at opposite ends of the console 12 and are fixed to the bottom wall 57 along the end edges 62 thereof. As support brackets 160 are identical to one another, only one of same will be described here. Support bracket 160 includes a straight and elongate arm portion 161 which defines therein an elongate mounting slot 162. The rearward end of the arm portion 161 is connected to a C-shaped clamp portion 163 which opens sidewardly. A lower leg 164 of the clamp portion 163 includes a threaded hole which receives therein a set screw. The support brackets 160 are mounted to the bottom wall 57 of console 12 by placing the respective arm portions 161 on the lower surface of bottom wall 57 along the opposite end edges 62 thereof. Screws or other fasteners are then inserted into mounting slot 162 and into preformed holes in bottom wall 57 to securely fasten the respective support bracket 160 to wall 57. In the illustrated embodiment, the support brackets are constructed of a rigid material, such as metal.

Console 12 additionally includes a planar bottom plate 165. Plate 165 is defined by a pair of convex edges .166 which define the longitudinal sides of plate 165, and a pair of parallel and straight end edges 167 which interconnect the respective convex edges 166. Bottom plate 165 is shorter in length than the bottom wall 57 and is mounted to same by placing plate 165 between the respective support brackets 160 so that the end edges 167 thereof lie closely adjacent and are generally parallel to the respective arm portions 161. Bottom plate 165 is provided with a plurality of mounting holes through which screws or other fasteners extend to fix plate 165 to the lower surface of bottom wall 57. Once installed on bottom wall 57, significant portions 168 of the bottom plate 165 project horizontally beyond the respective front and rear edges 60 and 61 of bottom wall 57 (see FIG. 9), and in this regard, convex edges 166 match or follow the inner contour of the respective main walls 135 of screens 134.

With the bottom plate 165 installed on bottom wall 57 of frame 40, the screens 134 can then be mounted on the outer faces of console 12 as follows. Screen 134 is positioned in an upright manner so as to face the respective front or rear wall 41, 42 of frame 40, and so that the bottom wall 150 of screen 134 is positioned below the respective outwardly projecting portion 168 of bottom plate 165. The opposite flanges 153 are inserted into the respective notches 63A defined behind the guides 63 as shown in FIG. 11, and the,first and second legs 156 and 157 of one of the mounting members 154 are inserted into the enlarged area 52 of the corresponding vertical slot 51 so that the first leg 156 passes through the enlarged area 52 and the second leg 157 hooks around and engages the inwardly facing surface 170 of the respective front or rear wall 41. The opposite mounting member 154 is then inserted into the enlarged area 52 of the opposite vertical slot 51. In this regard, the screens 134 in the illustrated embodiment are constructed of a lightweight material, such as plastic, and are somewhat flexible so that the side walls 145 thereof can be flexed slightly inwardly to permit insertion of the mounting members 154 into the corresponding enlarged areas 52.

To provide access to the interior of the console 12, each screen 134 is vertically adjustable into a plurality of positions relative to the respective front or rear wall 41, 42. More specifically, the vertical position of the screen 134 can be adjusted from the fully raised position illustrated in FIG. 2 to a lower position by gripping the handle 142 thereof and applying a downwardly directed force to the screen 134 so that same slides downwardly within the limits of the vertical slots 51. During this sliding movement, the flanges 153 are guided within the respective notches 63A of bottom wall 57, and the second leg 157 engages the inner surface 170 of the respective front or rear wall 41, 42 regardless of whether the respective first leg 156 is positioned within the upper enlarged area 52 or the lower narrower portion of slot 51. To completely remove the screen 134, a slight inward pressure is applied to one or both of the side walls 145 adjacent the respective mounting members 154 so as to disengage the second legs 157 from the respective front or rear wall 41, 42.

With the screens 134 installed on the frame 40, the outwardly projecting portions 168 of bottom plate 165 along with the inner surfaces 137 of the respective screens 134 define a pair of receptacles or bins 172 adjacent each of the front and rear walls 41 and 42. These bins 172 can be utilized for storing cabling 16 and 17 therein. Further, the portions 168 of the bottom plate 165 define the lowermost extent of the respective bins 172, and as a screen 134 is lowered, these portions 168 prevent any cabling within the bin 172 from dropping along with the screen 134. Further, the convex edges 166 of plate 165, in one embodiment, can serve as a guide as the screen 134 is raised and lowered.

To install the console 12 on the worksurface 11, the clamp portions 163 of the respective support brackets 160 are positioned around the lower cross bar 36, and set screws are inserted upwardly through the respective holes and turned until same clampingly engage cross bar 36. The console 12 is thus positioned beneath the worksurface 11 adjacent the rear edge 23 thereof generally under recess 26, and in the illustrated embodiment projects only slightly horizontally beyond rear edge 23 so that cabling 16 and 17 can be routed from the upper surface 20 of worksurface 11 and downwardly through recess 26 and into console 12.

Figure 12:
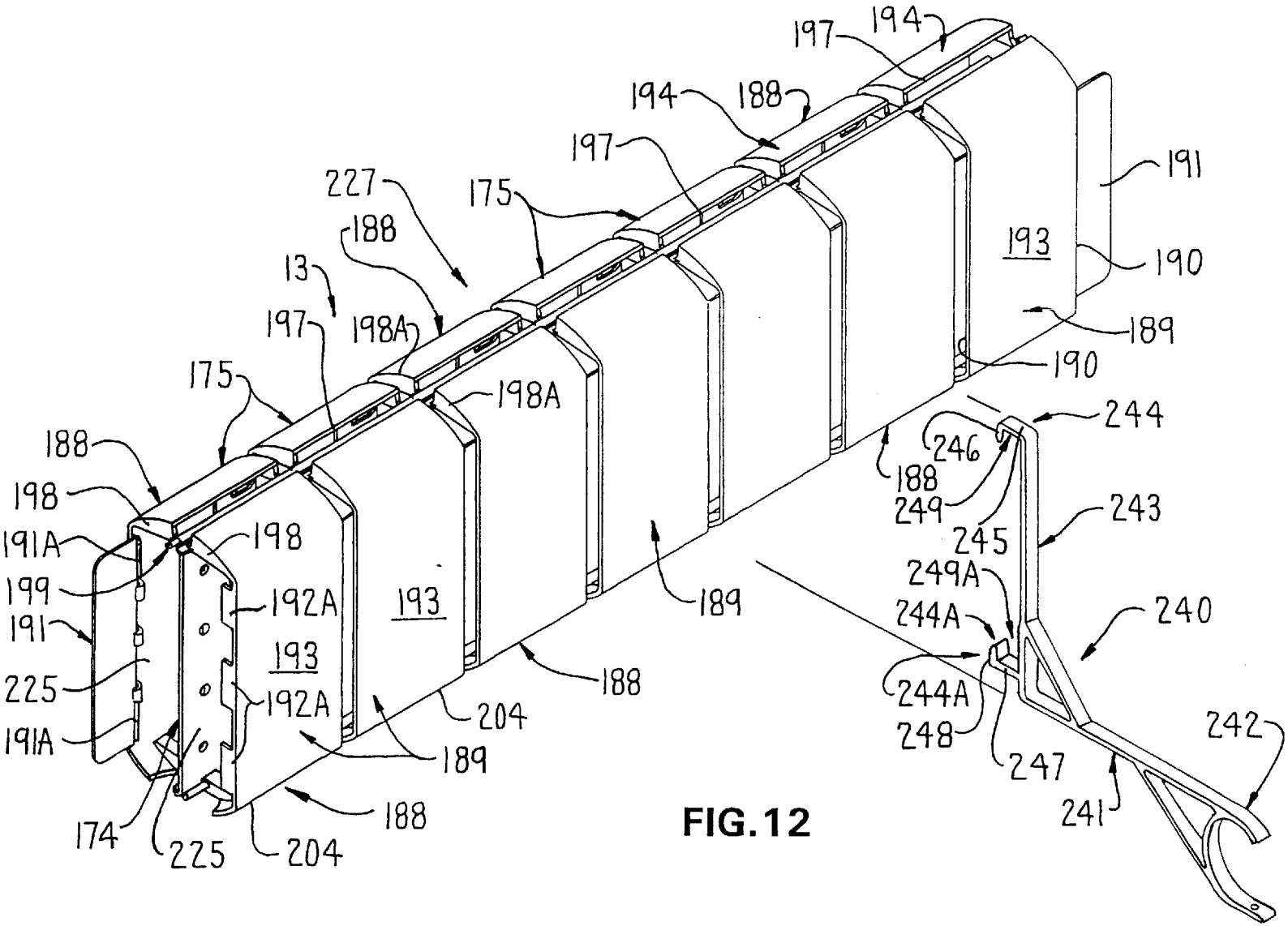
FIG. 12 is an enlarged perspective exploded view of a raceway run and support bracket, with the individual raceway covers or links in closed positions.

Turning now to raceway assembly 13, and with reference to FIG. 12, same generally includes an elongate centrally located spine 174 which removably mounts thereon a plurality of adjacent cover members or links 175. The spine 174 and cover members 175 together define an elongate chain or raceway for accommodating power and communication cables.

Figures 13, 14:
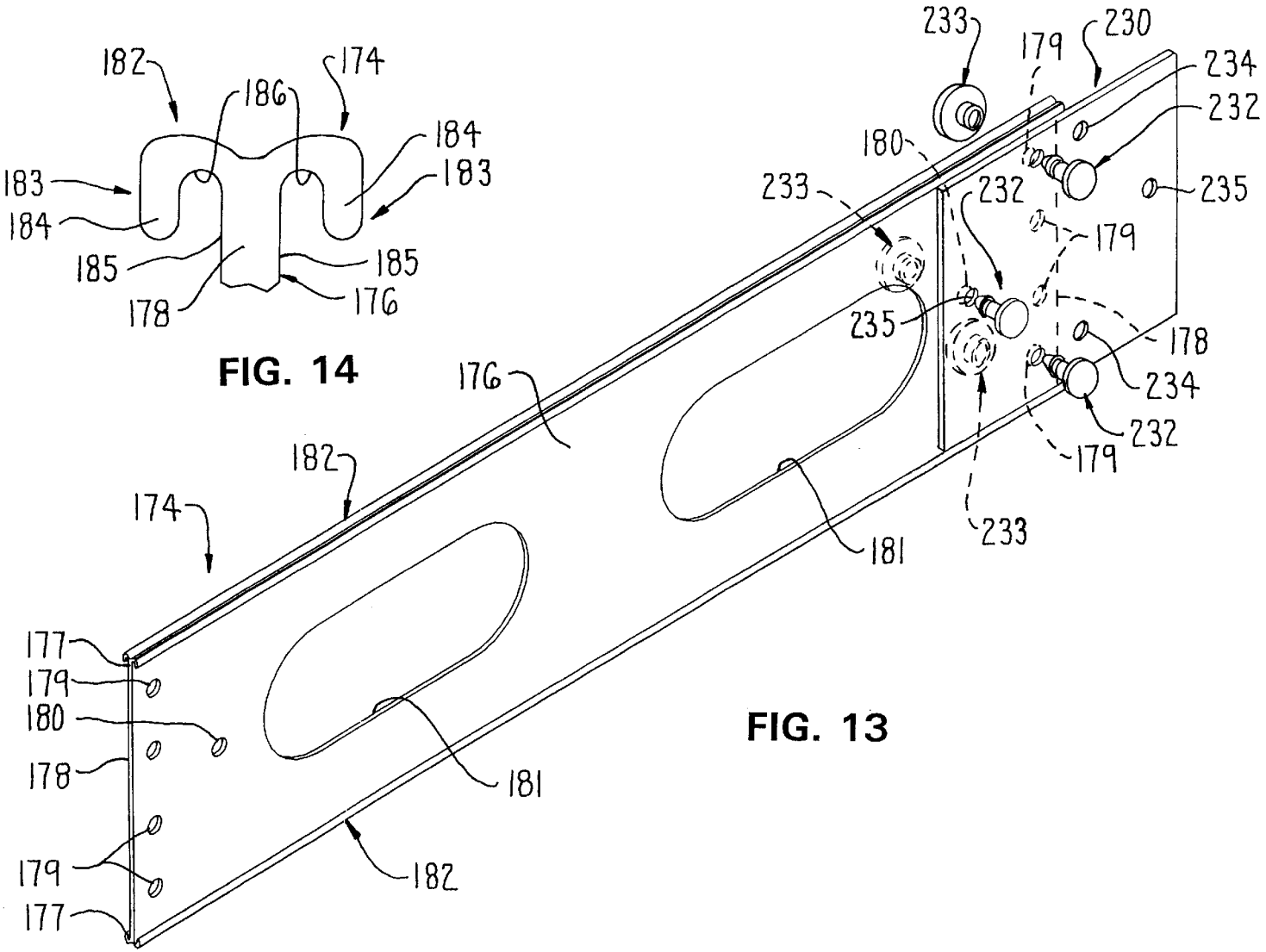
FIG. 13 is an enlarged perspective exploded view of the spine and a connector plate mounted on one end thereof.
FIG. 14 is an enlarged fragmentary end view of the upper end of the spine.

Referring to FIGS. 13 and 14, spine 174 includes an upright main wall section 176 defined by upper and lower substantially parallel longitudinal edge portions 177 and transverse edges 178 which are substantially parallel to one another and extend between and interconnect edge portions 177. A row of mounting holes 179 are defined in main wall section 176 along the respective edge portions 178, and an additional mounting hole 180 is provided inwardly of holes 179. Further, in the illustrated embodiment, main wall section 176 defines therein a plurality of horizontally elongate openings 181 for a purpose as discussed below.

The longitudinal edge portions 177 of main wall section 176 define respective upper and lower connector members 182. It will be appreciated that the lower connector member 182 is identical to, but inverted relative to upper connector member 182, and therefore only upper connector member 182 will be discussed in detail herein. Upper connector member 182 includes a pair of hooks 183 each of which projects horizontally sidewardly away from the main wall section 176 and then projects downwardly to form vertically short side walls or flanges 184 which are horizontally spaced from the respective opposite upright surfaces 185 of main wall section 176 so as to define a pair of elongate and downwardly opening and elongate right and left channels 186 disposed in side-by-side relation with one another. The upper and lower connector members 182 of spine 174 thus respectively define downwardly and upwardly opening channels 186 the mouths of which are opposed to one another and extend along the entire longitudinal extent of spine 174. Further, the terminal ends of the channels 186 open sidewardly adjacent edges 178 of spine 174.

The spine 174 may be constructed of plastic so as to enable horizontal flexing thereof in the horizontal direction, but may also be constructed of lightweight metal, such as aluminum.

Figure 17:
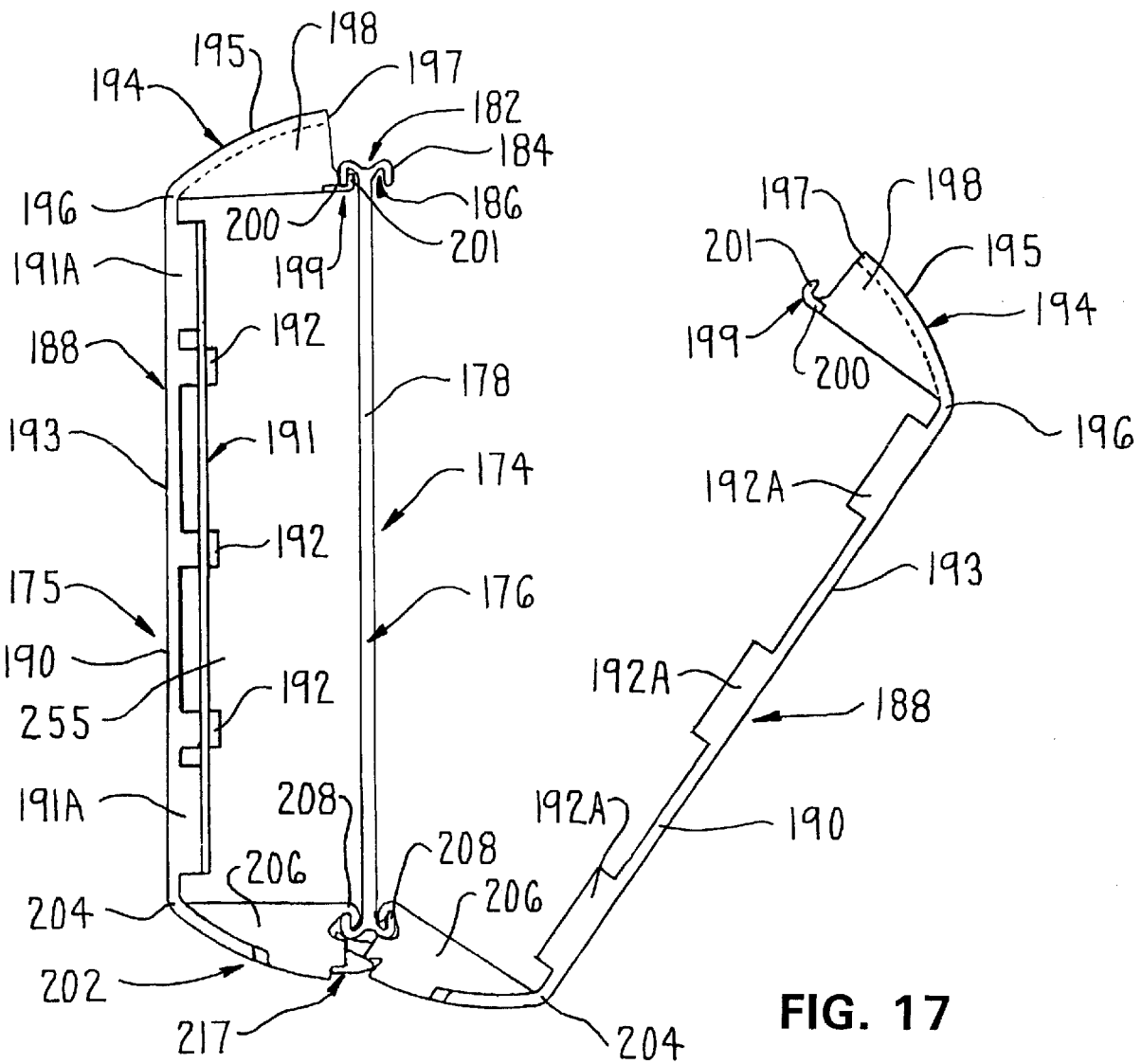
FIG. 17 is an enlarged end view of a raceway cover assembled onto the spine with the right half thereof in the open position.

The cover members 175 are embodied by right and left side covers or halves 188 which are identical to one another. Accordingly, only one of such side covers 188 will be described here. The side cover 188 is generally C-shaped (FIG. 15) and is defined by an upright side panel 189 defining a pair of vertical end edges 190. A flange 191 extends vertically along one end edge 190 and is fixed relative to edge 190 via a plurality of supports 192 which position flange 191 so that same is generally parallel to outer surface 193 of side panel 189, but is inset slightly horizontally inwardly relative to the outer surface 193. These supports 192 also act as hinges so as to allow some swinging movement of flange 191 vertically about the supports 192. Upper and lower flanges 191A are also provided along edge 190 and project perpendicularly relative to flange 191. A plurality of shorter flanges or tabs 192A are provided vertically along the opposite edge 190 and are generally perpendicular to side panel 189. Side cover 188 also includes a top section 194 defined by a convexly shaped upper wall 195 which is cantilevered inwardly from an upper terminal edge 196 of side panel 189 and terminates in a straight inner generally horizontal edge 197. Upper wall 195 also has a pair of generally planar end walls 198 which project downwardly a short distance from each transverse edge 198A of wall 195. The inner ends of end walls 198 adjacent terminal edge 197 of upper wall 189 each mount thereon a hook 199 defined by a generally horizontal lower leg 200 and a generally vertical upper leg 201 which projects upwardly from an inner end of leg 200. As best shown in FIG. 17, hook 199 is shaped so as to cooperatively engage within a channel 186 of upper connector member 182. More specifically, leg 201 of a left side cover 188 engages within left channel 186 of upper connector member 182. The hook 199 formed on the opposite end wall 198 of top section 194 is a mirror image of the above-described hook and will not be described herein.

Side cover 188 also includes a bottom section 202 defined by a convex lower wall 203 which is cantilevered inwardly from a lower terminal edge 204 of the respective side panel 189 and terminates in a straight edge 205. A pair of wedgeshaped and elongate and identical fastening elements 206 project upwardly from an upwardly facing inner surface 207 of lower wall 203 and are generally parallel and horizontally spaced from one another and oriented transversely relative to edge 205. Inner ends of the fastening elements 206 define thereon a downwardly depending hook part 208 and a sidewardly opening recess 209 extending generally horizontally and outwardly of hook part 208.

Figure 15:
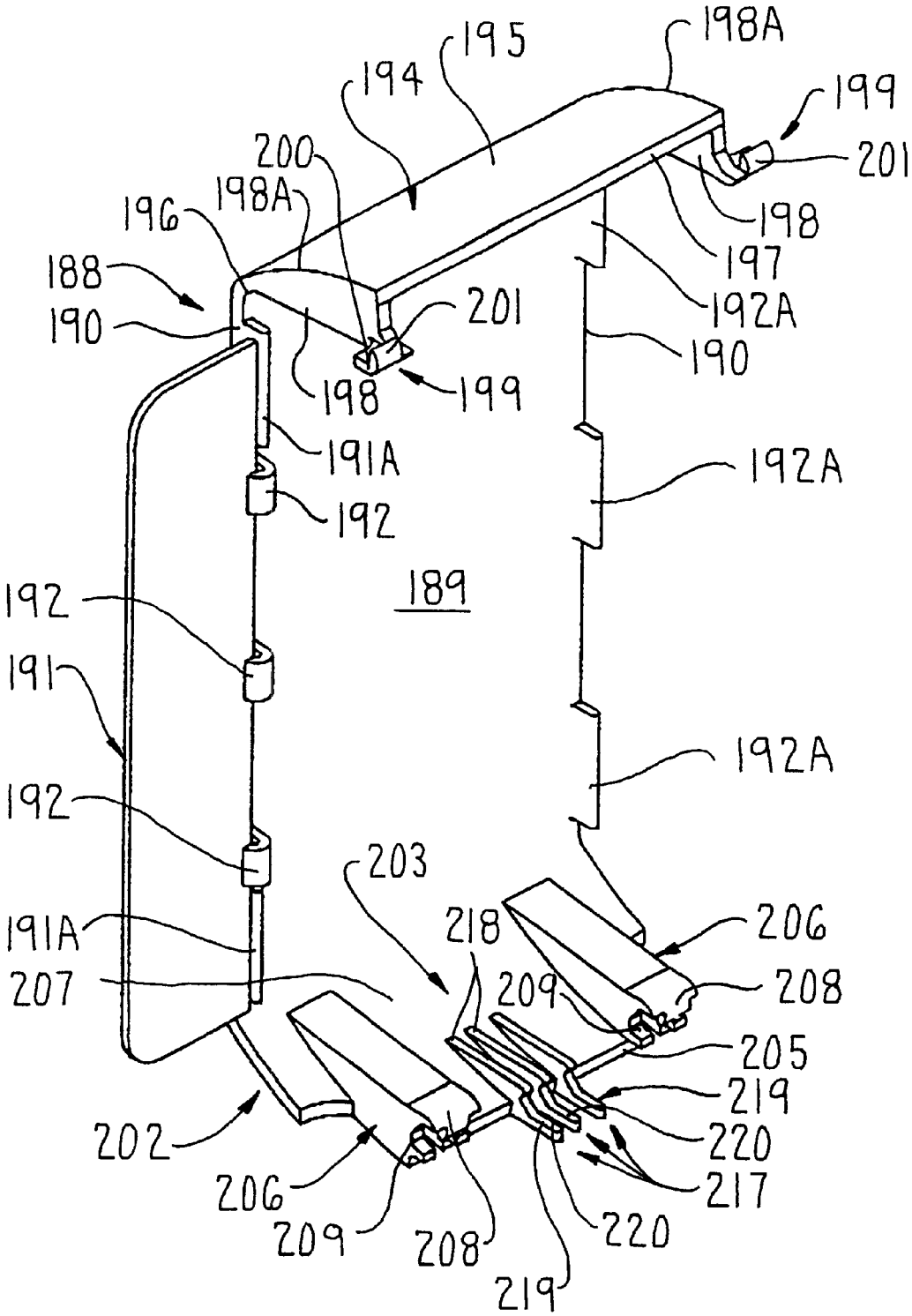
FIG. 15 is an enlarged perspective view of half of a raceway cover.
Figure 18:
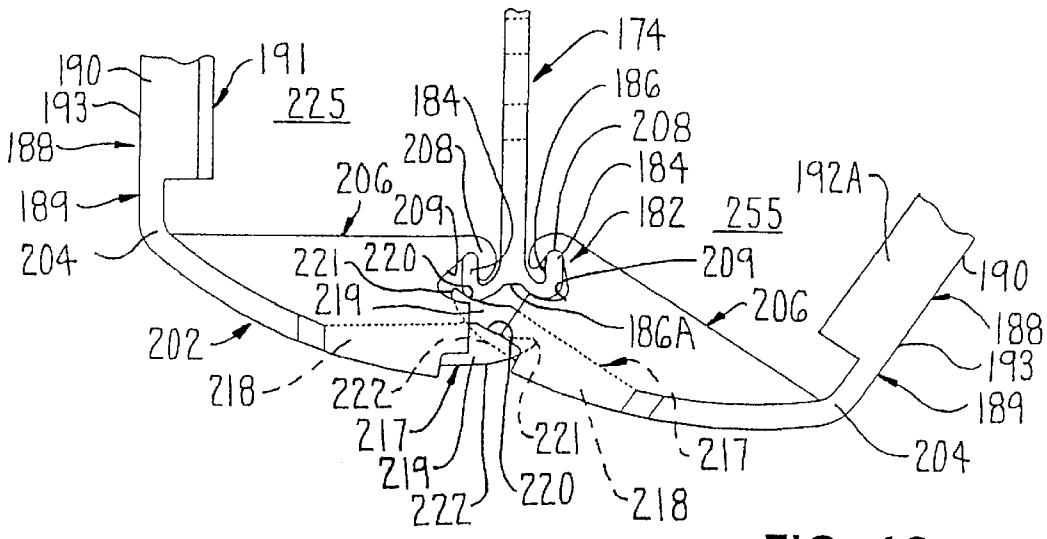
FIG. 18 is an enlarged fragmentary detail view of the raceway cover of FIG. 17.

A plurality of elongate and generally parallel alignment members or fingers 217 are formed on lower wall 203, the free ends of which project horizontally beyond edge 205. More specifically, fingers 217, as best shown in FIGS. 15 and 18, have outer end portions 218 which are fixed to and project upwardly from surface 207 of bottom wall 202, and inner end portions 219 which are joined to the respective edges of outer end portions 218 adjacent edge 205 and project horizontally therebeyond. The inner end portions 219 each define a curved and upwardly facing stop surface 220 thereon which extends from the juncture of inner and outer end portions 218 and 219 to the inner free end 221 of the respective inner end portion 219. As best shown in FIG. 18, fingers 217 are disposed below the respective fastening elements 206 and extend inwardly a short horizontal distance beyond hook part 208. In addition, the rearmost finger 217 (FIG. 15) is positioned a further distance from the centermost finger 217 as compared to the distance defined between the frontmost and centermost fingers 217. Each finger 217 also defines thereon a curved lower surface 222 opposite the respective stop surface 220, which lower surface 222 curves upwardly and adjoins inner free end 221 to provide same with a generally pointed configuration.

The side covers 188 are assembled onto the spine 174 by inserting the left flange 184 of lower connector member 182 of spine 174 into the respective left recesses 209 of left side cover 188 so that the hook parts 208 project downwardly into the left channel 186 of lower connector member 182 and so that the fingers 217 are spaced slightly vertically downwardly therefrom. The inner legs 201 of the hooks 199 of top section 194 are then inserted upwardly into the top left channel 186 of upper connector member 182 by flexing the upper wall 195 slightly downwardly to allow leg 201 to pass the lower edge of the respective flange 184. The right side cover 188 is assembled onto the opposite side of spine 174 in a similar manner. That is, the right side cover 188 is aligned with left side cover 188 by positioning the fingers 217 of right side cover 188 below lower connector member 182 and so that rearmost finger 217 (with reference to FIGS. 15 and 16) of right side cover 188 lies along the side of rearmost finger 217 of left side cover 188, the centermost finger 217 of right side cover 188 is between the centermost and rearmost fingers 217 of left side cover 188, and the frontmost finger 217 of right side cover 188 is between the frontmost and centermost fingers 217 of left side cover 188, which serves to align the two covers 188 so that the opposite upright edges 190 thereof are essentially horizontally aligned with one another. The hook parts 208 of the respective fastening elements 206 of right side cover 188 are inserted downwardly into the right channel 186 of lower connector member 182, and the inner legs 201 of the hooks 199 of right side cover 188 are inserted upwardly into the top right channel 186 of upper connector member 182 by flexing upper wall 195 of right side cover 188 downwardly and releasing. The right and left side covers 188 may be attached to spine 174 in any order, and the above is presented only as an example.

With the left and right side covers 188 assembled onto spine 174, a pair of right and left channels or conduits 225 are defined on opposite sides thereof. One of such conduits 225 may be utilized for communication cabling such, and the opposite conduit 225 may be utilized for power lines. The right and left side covers 188 once installed onto the spine 174 together define an enclosed and hollow cover or link 175. Additional covers 175 can then be installed in an end-to-end manner along the spine 174 to define a continuous raceway run 227. As shown in FIG. 12, the flanges 191 of the side covers 188 when the right and left side covers 188 are assembled into a single cover 175 project in opposite directions and from opposite sides of the respective cover 175. These flanges 191 project partially into the interior of the adjacent cover 175 and lie closely adjacent the inner surface of the side panel 189 of the adjacent side cover 188 to further enclose the respective conduit 225 from the side. Further, as mentioned above, spine 174 in the illustrated embodiment is constructed of an at least partially flexible material which permits the raceway run 227 to flex in the horizontal direction. As such, when a horizontal bend in the run 227 is desirable or necessary (see FIG. 1), then the cover members 175 will follow the bend of the spine 174.

Figure 16:
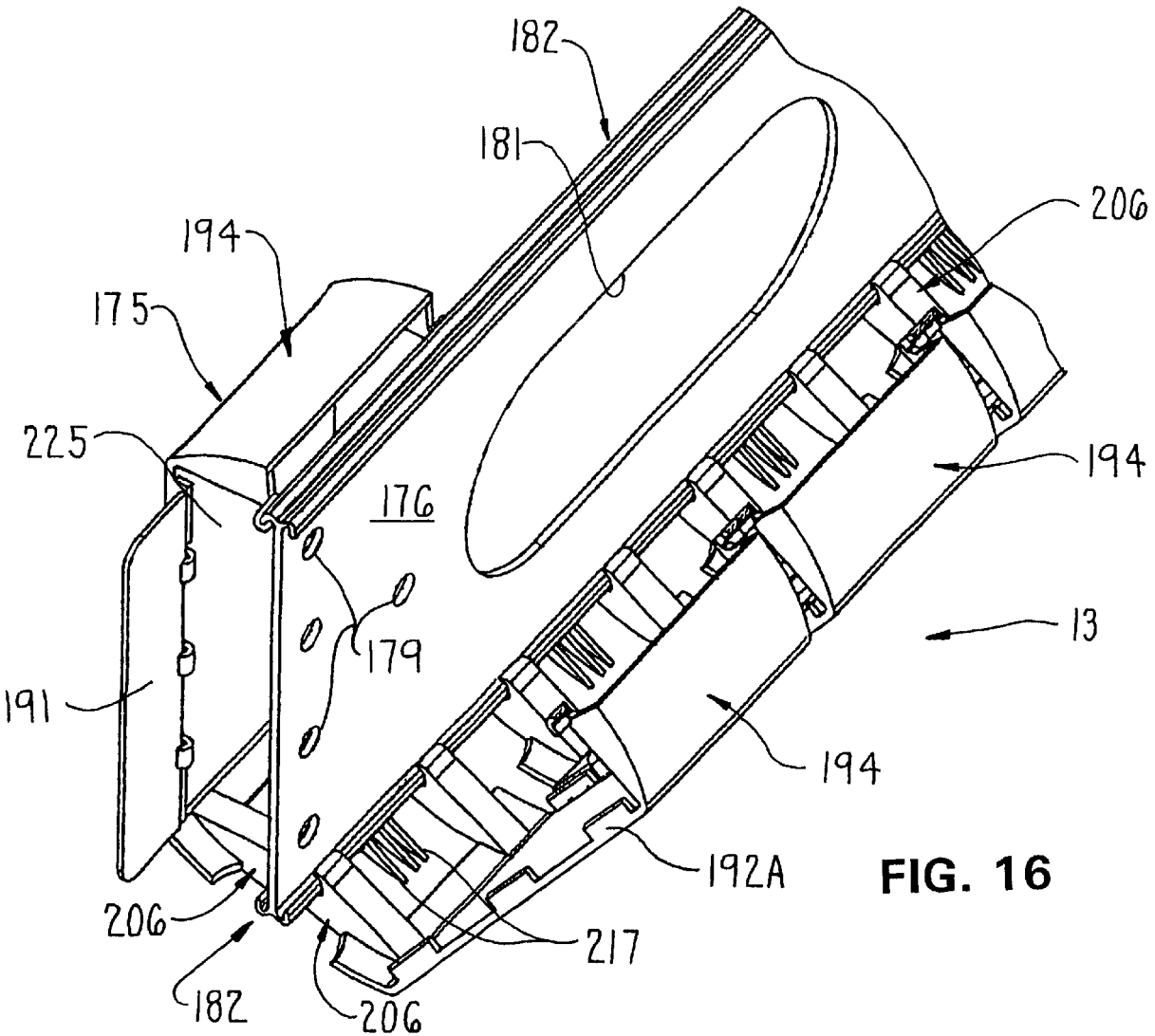
FIG. 16 is an enlarged fragmentary perspective view of the end of a raceway run with the right side of the raceway in an open configuration.

As shown in FIGS. 16–18, the right and left side covers 188 can be pivoted outwardly relative to one another into an open position so as to define an angle of approximately 30 to 45 degrees relative to the horizontal, and in the illustrated embodiment side covers 188 are pivotable to define about a 35° angle relative to the horizontal. For example, if it is desirable to access cabling disposed in the right conduit 225, then the right side cover 188 is opened by applying a downwardly directed force on upper wall 195 thereof adjacent terminal edge 197 to release the respective hooks 199 from upper connector member 182. The right side cover 188 can then be swung downwardly which causes the hook part 208 of bottom wall 202 to pivot about the upper end of the flange 184 of the lower connector member 182 which causes the alignment members 217 of right side cover 188 to pivot upwardly until the stop surfaces 220 thereof engage the lower curved end of left side flange 184 of lower connector member 182, and thus further downward movement of the side cover 188 is prevented. The right side cover 188 is then closed by swinging same upwardly and reengaging the upper hooks 199 within the respective channel 186 of upper connector member 182. The left side covers 188 can be opened and closed in a similar manner. Further, the openings 181 defined along spine 174 provide additional clearance for the connector heads 105 of the serially connected CDAs 106 as discussed above.

As shown in FIG. 13, the spines 174 of raceway runs 227 can be connected to one another via a connector plate 230. Connector plate 230 is attached to a terminal end of the spine 174 of one raceway run 227 using two-piece snap connectors having a male part 232 and a female part 233. Connector plate 230 defines a plurality of holes 234 and 235 which respectively correspond in location to the mounting holes 179 and 180 of spine 174. The male parts 232 of the connector extend through the aligned holes of the plate 230 and spine 174 and the terminal ends of male parts 232 are snapped into corresponding female parts 233 to attach the plate 230 to a spine segment 174. The opposite set of holes 234 and 235 of plate 230 are then attached to the terminal end of the spine 174 of the next raceway run 227 in a similar manner to interconnect the raceway runs 227 to one another. It will be appreciated that other types of releasable fasteners may be utilized in place of snap connectors 232, 233.

In one embodiment, spines 174 can be sold in predetermined lengths, for example ten foot lengths, so that ten foot raceway runs 227 can be assembled and connected in series with one another to create the desired raceway length for the particular area. Shorter lengths of raceway runs 227 can be created by cutting the spine 174 to the desired length and using connector plates 230 to interconnect the shorter raceway run 227 to an adjacent run 227. In this regard, the terminal end of the cut-to-length spine segment 174 would then be repunched or drilled to create the appropriate mounting holes 179, 180 using an alignment plate (not shown) or by using a connector plate 230 as a guide.

Connector plates 230 may also be utilized to connect the terminal end of a raceway run 227 to console 12, and specifically so as to communicate with a raceway port 133 thereof. Referring back to FIG. 5, one end of a connector plate 230 can be installed on the end of the spine 174 of a raceway run 227 as discussed above. The opposite end of the connector plate 230 can then be attached to the center plate 64 of console 12 utilizing the correspondingly located mounting holes 72 defined along the edge of center plate 64 and snap connectors. The projecting flange 191 of the corresponding side cover 188 projects partially into the raceway port 133. An additional raceway run 227 may then be attached to the opposite raceway port 133 of the console 12. Alternatively, the terminal ends of the spines 174 can be directly attached to center plate 64 with snap connectors.

As shown in FIG. 3, raceway runs 227 can be serially attached to one another so as to interconnect a pair of worksurfaces 11, and the horizontal flexibility of the raceway runs 227 permits easy reconfiguration of the worksurfaces 11 relative to one another, for example so that same can be disposed in parallel or various angled relations with respect to one another.

As shown in FIGS. 4 and 12, the raceway runs or segments 227 are supported on the lower cross bar 36 of worksurface 11 via supports or brackets 240. Bracket 240 is generally L-shaped and has a horizontal arm 241 which at one end mounts thereon a C-shaped clamp member 242 which is substantially identical to clamp portion 163 of bracket 160 and will therefore not be discussed further herein. The opposite end of arm 241 mounts thereon an upright brace 243 having upper and lower ends which define respective upper and lower hook structures 244 and 244A thereon. Upper hook structure 244 includes a horizontal part 245 which is cantilevered from an uppermost end of brace 243 and a vertical part 246 which projects downwardly from a terminal end of part 245 so as to be oriented generally perpendicular relative thereto. Lower support structure 244A includes a horizontal leg 247 which is cantilevered from a lowermost end of brace 243 and a vertical leg 248 which projects upwardly from a terminal end of leg 247 and is perpendicular thereto. The upper and lower hook structures 244 thus respectively define a pair of upwardly and downwardly opening recesses 249 and 249A.

Figure 19:
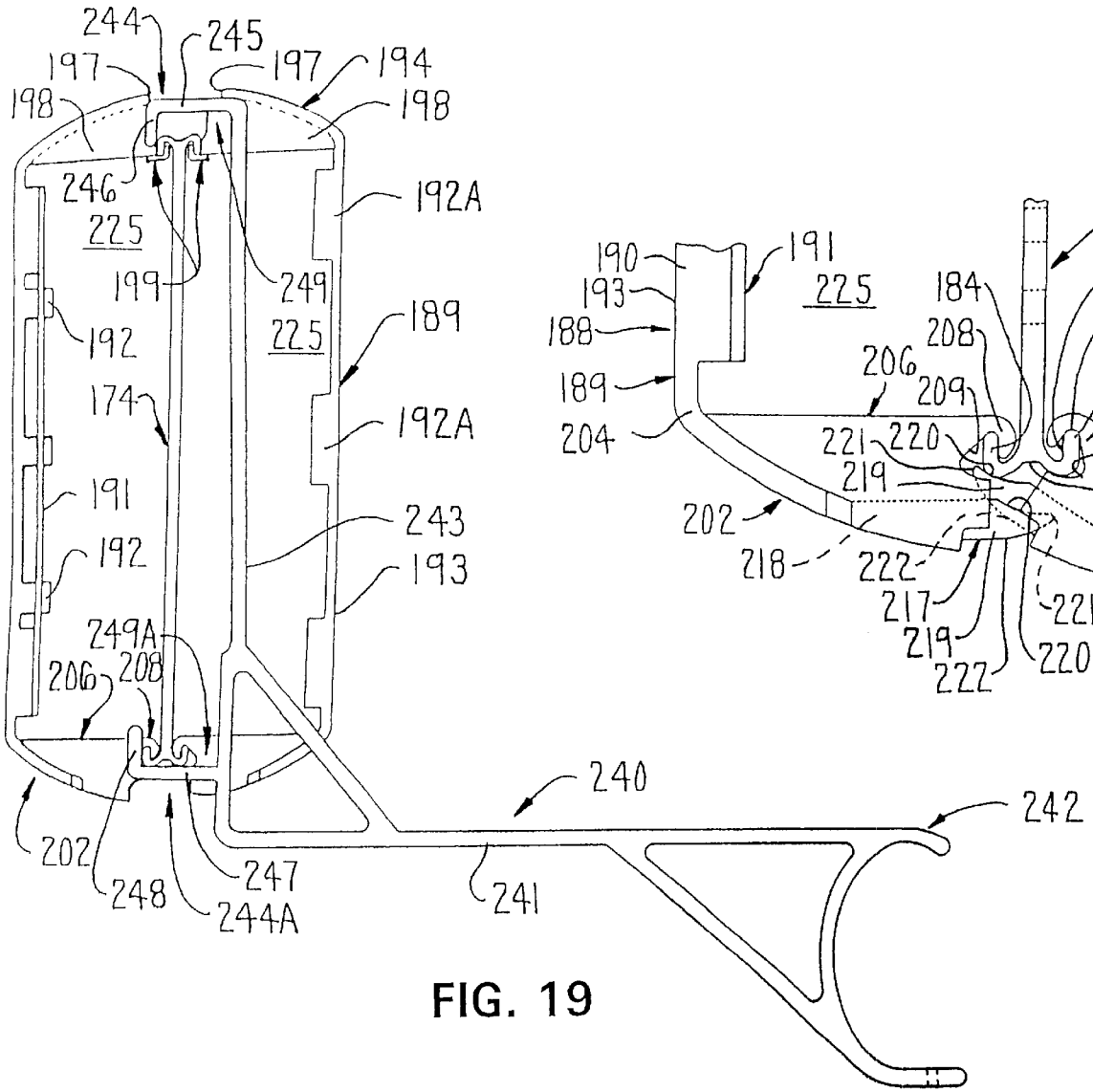
FIG. 19 is an enlarged view similar to FIG. 17, but with the raceway cover in a closed position and illustrating the support bracket mounted thereon.

With reference to FIGS. 12 and 19 the support bracket 240 is mounted on a raceway run 227 as follows. With the run 227 already installed onto console 12 as discussed above, the upper end of brace 243 (i.e. upper hook structure 244) is positioned beneath and between a pair of adjacent raceway covers 175 and inserted upwardly into a conduit 225. The lower connector member 182 of spine 174 is seated in recess 249A of lower hook structure 244A, and the upper hook structure 244 is positioned so as to extend over the upper connector member 182 of spine 174 so that part 246 of upper hook structure 244 engages the outer side of the remote flange 184. The clamp member 242 is positioned around cross bar 36 and a set screw is inserted upwardly into the lower arm of clamp member 242 and tightened so as to pressingly engage bar 36. Support brackets 240 may be utilized sidewardly of console 12 to lift the raceway runs 227 as necessary.

Figure 19A:
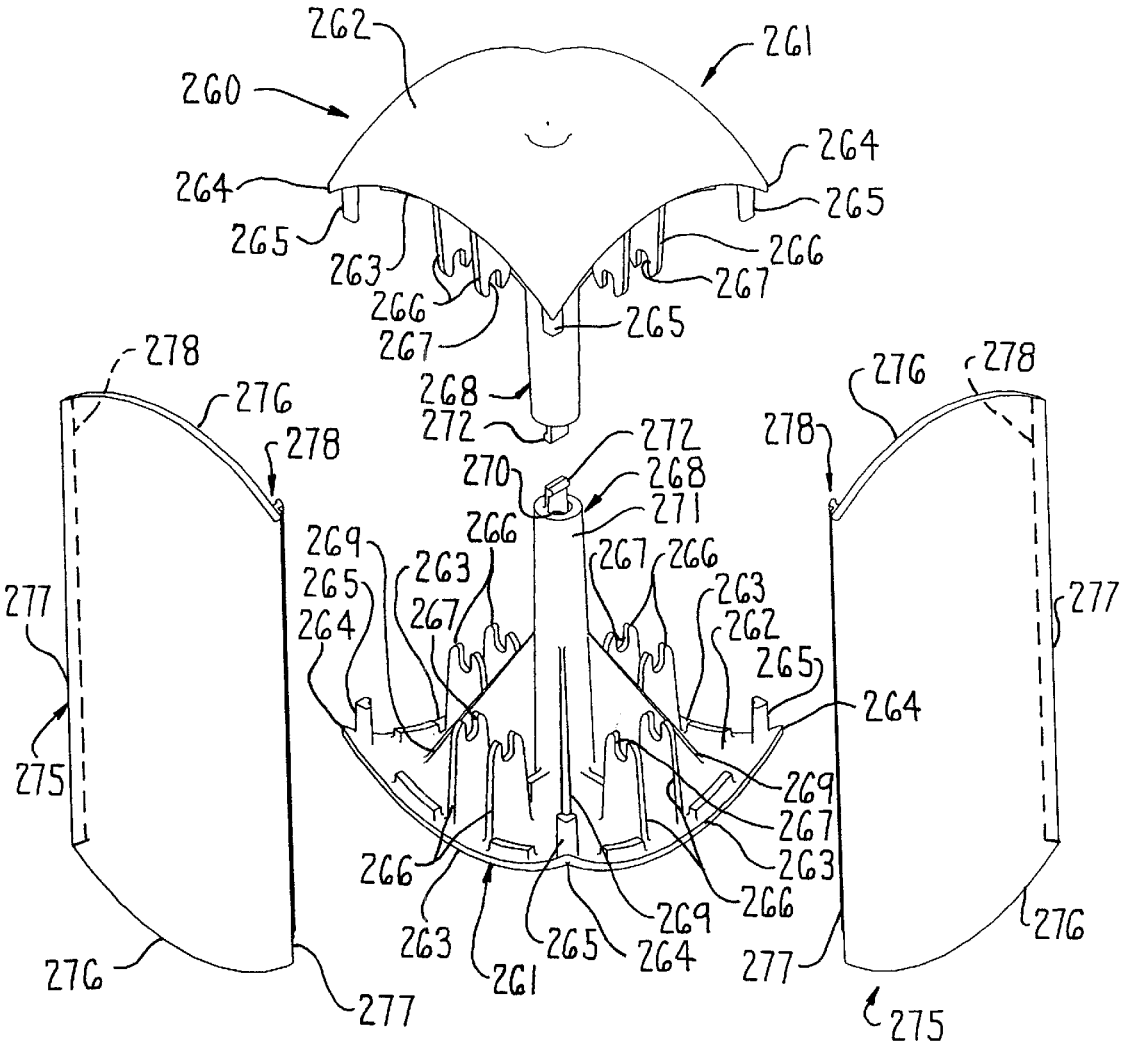
FIG. 19A is an enlarged perspective exploded view of the corner connector.

As shown in FIG. 19A, raceway assembly 13 also includes a corner connector 260 which permits connection of pairs of raceway runs 227 in 90 degree corner configurations. Corner connector 260 has upper and lower caps or end parts 261. Upper and lower caps 261 are identical to one another and when connected together, one of same is inverted relative to the other. Therefore, only lower cap 261 will be described in detail here. Lower cap 261 includes a bottom wall 262 having a generally convex shape which is bordered by four edges 263. Edges 263 each have an arcuate configuration which is similar to the convex shape of bottom walls 202 of the individual raceway covers 175 (with the arcuate configuration of edges 263 of upper cap 261 being similar to the convex shape of top walls 194 of the raceway covers 175). Adjacent pairs of edges 263 adjoin one another at a corner 264. At each corner 264, a generally heart-shaped mounting peg 265 projects upwardly from bottom wall 262 (only three of which are shown in FIG. 19A). A pair of mounting plates 266 also project upwardly from bottom wall 262 generally centrally between each pair of adjacent pegs 265. The upper free ends of the respective plates 266 each define an upwardly opening notch 267 therein. The notches 267 of each adjacent pair of plates 266 are vertically and horizontally aligned with one another.

A generally tubular post-like connector 268 projects upwardly from a center region of bottom wall 262. A plurality of reinforcing webs 269 project sidewardly and downwardly from connector 268 for connection to bottom wall 262. The connector 268 defines a downwardly extending recess 270 therein which opens at an upper terminal end 271 thereof. A fastening member 272 projects upwardly from terminal end 271 and is disposed sidewardly of the mouth of recess 270, which fastening member 272 cooperates with the downwardly projecting fastening member 272 of upper cap 261 as discussed below.

A pair of identical side covers 275 are provided, each of which is defined by upper and lower convex edges 276 and a pair of upright vertical edges 277 which adjoin upper and lower edges 276. Further, a pair of flanges 278 are provided on the inwardly facing surface of the side cover 275 along the respective vertical edges 277 thereof. These flanges 278 are disposed and configured to cooperate with the mounting pegs 265 of upper and lower caps 261 as discussed below.

Upper and lower caps 261 are connected to one another as follows. The caps 261 are oriented so that the free ends 271 of connectors 268 are opposed to and vertically aligned with one another. Each of the fastening members 272 are then inserted into the respective recesses 270 of the opposite cap 261 by pushing the caps 261 toward one another. The lower ends of fastening members 272 project slightly vertically into the respective recesses 270 and a detent shoulder (not shown) is formed thereat. Thus, when the fastening member 272 is fully inserted into the recess 270 of the opposite end cap 261, the free end of same cooperatively engages with this detent member to snap the two caps 261 together and interconnect same. The fastening members 272 and the recesses 270 are configured such that when the caps 261 are connected to one another, the mounting pegs 265 of the lower end cap 261 are vertically aligned with and project toward a respective mounting peg 265 of the upper end cap 261. Further, the pairs of mounting plates 266 of the lower end cap 261 positioned along each edge 263 thereof are aligned with and project toward an opposite pair of mounting plates 266 of the upper end cap 261. The inwardly facing surfaces of the aligned and opposed pairs of mounting plates 266 thus together define a vertically oriented narrow channel.

Once the caps 261 are connected, a side cover 275 is then attached to the joined caps 261 by squeezing the side cover 275 so that the respective flanges 278 thereof are deflected slightly inwardly toward one another, positioning the flanges 278 between a pair of the aligned mounting pegs 265 of the upper and lower caps 261 and then releasing the pressure on side cover 275 so that the flanges 278 return to their normal position and engage the inwardly facing vertical sides of the respective mounting pegs 265 to fasten the cover 275 to the upper and lower caps 261. The other side cover 275 is attached to the end caps 261 in the same manner so that the side covers 275 are oriented approximately perpendicularly relative to one another.

With the corner connector 260 assembled as described above, a pair of raceway runs 227 can then be connected to the two open sides of connector 260 so as to create a 90 degree corner as follows. The terminal end of the spine 174 of a raceway run 227 is inserted into the elongate channel defined vertically between the opposed pairs of mounting plates 266 so as to align mounting holes 179 of spine 174 with the aligned recesses 267 of the respective upper and lower pairs of mounting plates 266. With the upper portion of the spine 174 engaged between the pair of upper mounting plates 266 and the lower portion of the spine 174 engaged between the pair of lower mounting plates 266, male and female snap connectors 232 and 233 can then be installed from opposite sides of the upper and lower pairs of mounting plates 266 so that the respective male connectors 232 extend through one recess 267, the mounting hole 179 of spine 174 and then the opposite recess 267. The fastening of the spine 174 to the mounting plates 266 prevents sideward movement of the raceway segment 267 relative to the corner connector 260, but permits removal of the upper and lower caps 261 for disassembly purposes. The other raceway run 227 can then be connected to the remaining open side of connector 260 in the same manner to define a corner.

Figures 20, 21, 22:
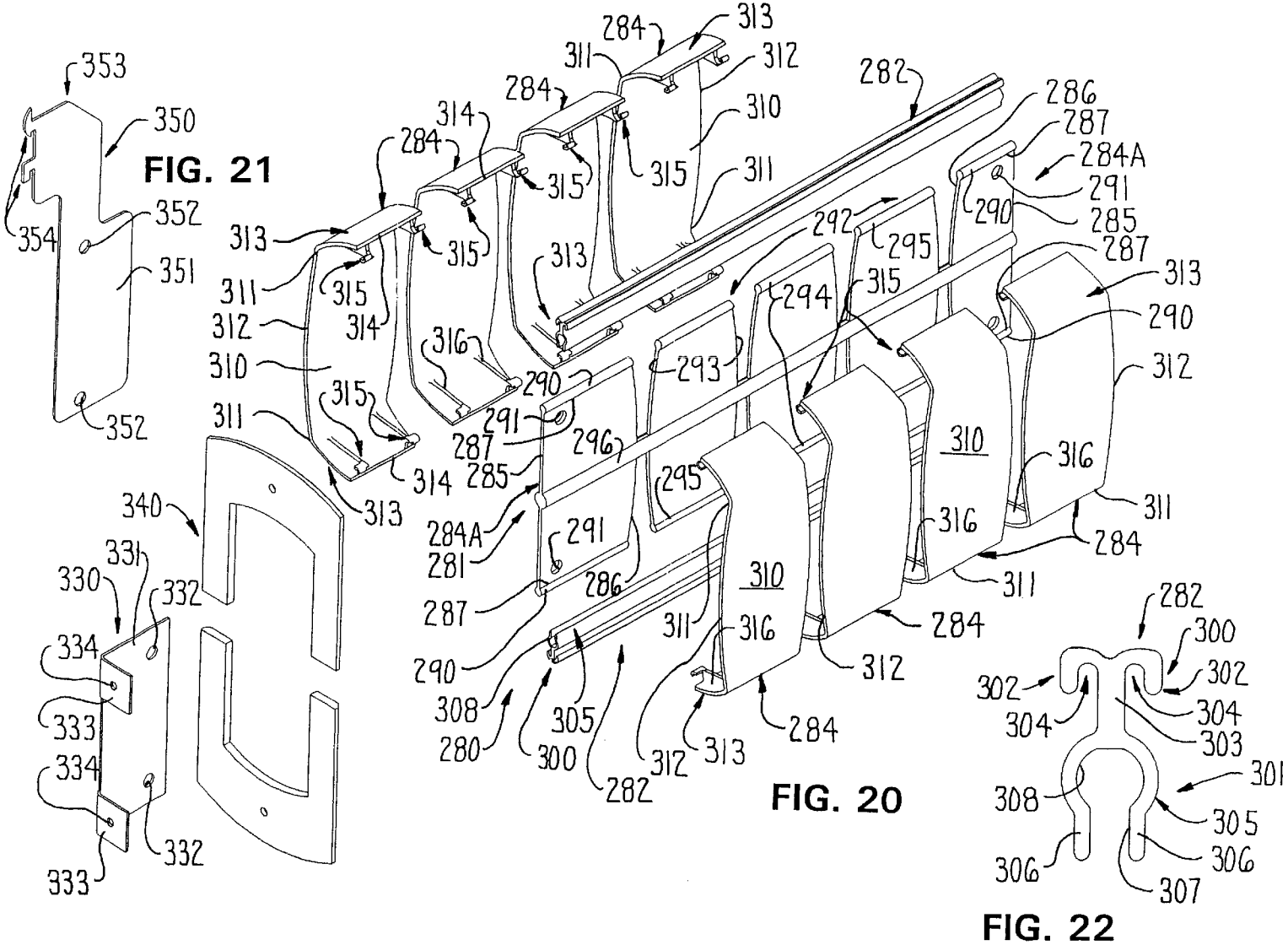
FIG. 20 is an enlarged perspective exploded view of the infeed raceway assembly and a wall or floor mounting bracket and bezel.
FIG. 21 is an enlarged perspective view of a panel mounting bracket.
FIG. 22 is an enlarged end view of the upper channel member of the infeed chain.
Figure 23:
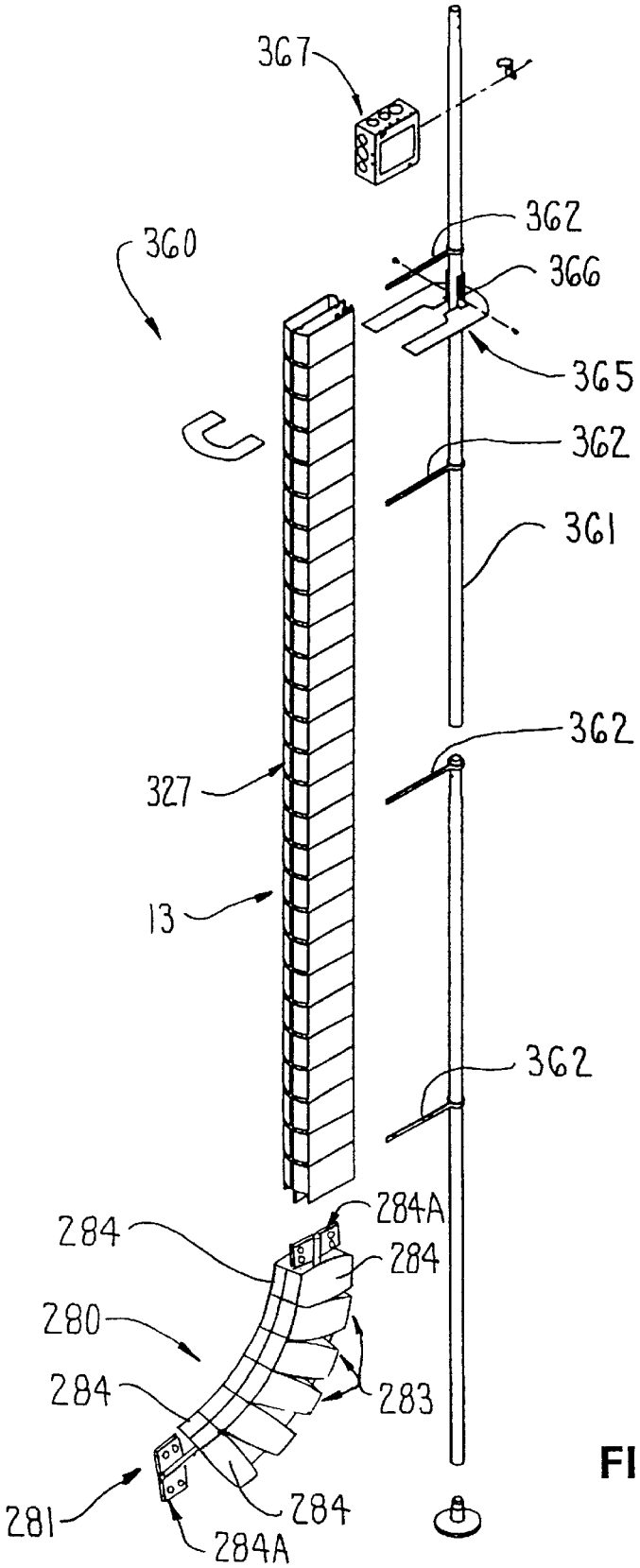
FIG. 23 is a perspective exploded view of an infeed arrangement for routing power and/or communication cabling from a ceiling area.

With reference to FIGS. 21–23, raceway assembly 13 additionally includes an infeed arrangement 280 which is vertically flexible and connectable to a free end of a raceway run 227 so as to permit infeed of cabling from a fixed wall, wall, portable wall panel, ceiling or floor, for example. Infeed arrangement 280 generally includes a central elongate support member or spine 281 which mounts thereon upper and lower elongate channel members 282, and a plurality of identical and substantially enclosed covers 283 defined by identical right and left shell-like side covers 284.

Infeed spine 281 is defined by a pair of end plates 284A disposed at opposite terminal ends thereof. Each end plate 284A has a straight upright end edge 285, an opposite arcuate or convex upright end edge 286 spaced horizontally from end edge 285, and parallel upper and lower edges 287 which adjoin end edges 285 and 286. End plates 284A each include upper and lower elongate rod-like portions 290 adjoined to and extending along the respective upper and lower edges 287, and a pair of vertically spaced mounting holes 291 disposed along the respective straight edges 285 thereof. A plurality of identical center plates 292 are disposed between the respective end plates 284A. Center plates 292 each include a pair of upright and convex edges 293 which are sidewardly spaced from one another and have reverse curvatures as compared to one another. These edges 293 are joined to one another by parallel top and bottom edges 294 which define rod-like portions 295 along the entire longitudinal extent thereof which are similar to rod-like portions 290 of end plates 284A. The respective end plates 284A and center plates 292 are joined to one another by an elongate and generally cylindrical bar 296 which extends along the respective plates 284A and 292 approximately midway between the upper and lower edges thereof. Plates 284A and 292 are joined to bar 296 so that the upright edges thereof are horizontally spaced from one another.

Infeed spine 281 mounts thereon top and bottom channel members 282. Top and bottom channel members 282 are inverted relative to one another, but are otherwise identical and therefore only top channel member 282 will be described. With reference to FIGS. 20 and 22, top channel member 282 includes first and second connector parts 300 and 301 which are adjoined to one another. First connector part 300 is similar to the upper connector member 182 of spine 174, and includes a pair of hooks 302 which project sidewardly and then downwardly from the upper terminal end of a main upright wall 303. Hooks 302 define a pair of elongate and downwardly opening right and left channels 304. Second connector part 301 includes an elongate tubular portion 305 the top of which is joined to a lower end of main wall 303 of first connector part 300 and the bottom of which opens downwardly through a pair of generally parallel side walls or flanges 306. Flanges 306 thus define a downwardly opening access 307 to an interior channel 308 defined by tubular portion 305.

The shell-like covers 283 are embodied by right and left side covers 284 which are identical to one another, and therefore only the left side cover will be described in detail with reference to FIG. 21. Side cover 284 includes an upright and generally planar side wall 310 defined by upper and lower straight edges 311, and a pair of convex side edges 312 which extend between and adjoin upper and lower edges 311. Top and bottom walls 313 are cantilevered inwardly from the respective upper and lower edges 311 of side wall 310. The top and bottom walls 313 are inverted relative to one another, but are otherwise identical. Further, top and bottom walls 313 are configured similarly to top wall 194 of cover member 188 discussed above. In view of the similarity between top and bottom walls 313, only top wall 313 is described in detail. Top wall 313 projects inwardly from upper edge 311 of side wall 310 and terminates at a straight inner edge 314. A pair of sidewardly spaced hooks 315 are mounted along a lower surface of top wall 313 via respective webs 316 and are positioned closely adjacent edge 314. Hooks 315 are similar to hooks 199 of side covers, 188 and will not be discussed further herein.

Infeed arrangement or chain 280 is assembled as follows. Upper and lower channel members 282 are assembled onto infeed spine 281 by pushing the respective upper rod-like portions 290 and 295 of plates 284A and 292 into the downwardly opening channel 308 of upper channel member 282, and the respective lower rod-like portions 290 and 295 of plates 284A and 292 into the upwardly opening channel 308 of lower channel member 282. The lower hooks 315 of a left side cover 284, for example, are then engaged within the upwardly opening left-side channel 304 of first connector part 300 of lower channel member 282, and the upper hooks 315 of left side cover 284 are engaged within the downwardly opening left side channel 304 of first connector part 300 of upper channel member 282. The right side cover 284 is then attached to the opposite side of infeed spine 281 in a similar manner to create a substantially enclosed cover 283. Additional left and right side covers 284 are then attached to infeed spine 281 to create an elongate infeed run or chain 280. The left and right side covers 284 may be attached to infeed spine 281 in any order, and the above is presented only as an example.

Due to the convex curvature of edges 286 and 293 of end and center plates 284A and 292, infeed chain 280 is flexible in the vertical direction, and doing so causes sliding of the rod-like portions 290 and 295 within the respective channels 308 so that a vertical bend in chain 280 can be formed. The end plates 284A are connectable to the terminal end of a spine 174 of a raceway run 227 either directly or via a connector plate 230 and the male and female snap connectors 232 and 233.

In the situation where power and/or communication cabling is routed through a fixed upright wall structure, the terminal end of the infeed chain 280 is fastened to a support bracket 330 as shown in FIG. 20. The support bracket 330 includes a flat plate-like part 331 which defines therein a pair of mounting holes 332, and a pair of vertically spaced side brackets 333 which are cantilevered from an upright edge of part 331 and are perpendicular thereto. Side brackets 333 also define mounting holes 334 therein. Part 331 of bracket 330 is fastened directly to a respective end plate 284A (or using a connector plate 230) of infeed chain 280 with snap connectors 232, 233, and the side brackets 333 are then fastened to the wall. To provide a finished appearance, a two-piece bezel 340 may be fixed to the wall around the opening defined therein, with the terminal end of the infeed chain 280 abutting or lying closely adjacent the outwardly facing surface thereof. The bracket 330 and bezel 340 may also be used to route the infeed chain 320 to a horizontal support surface or floor.

In the situation where power and/or communication cabling is routed through a portable wall panel, bracket 350 shown in FIG. 21 is substituted for bracket 330. Bracket 350 is defined by a lower flat plate 351 defining mounting holes 352 therein used to attach bracket 350 directly to an end plate 284A of infeed chain 280 (or with a connector plate 230), and an upper flat plate 353 which defines thereon a pair of hooks 354 configured to cooperate with accessory slots defined either in vertical edge frame members of conventional space-dividing panels or alternatively in upright support or connector posts of conventional space-dividing panel systems.

The vertically flexible infeed chain 280, in one embodiment, may be utilized to interconnect a raceway run 227 to a power and communication cabling infeed area, one example of which shown in FIG. 23, or to create vertical bends in a raceway run 227 as necessary. The infeed arrangement 360 illustrated in FIG. 23 may be used where it is necessary to route infeed cabling downwardly through a ceiling and into a work area. The arrangement 360 includes an upright support rod or post 361 having a lower end which supportingly engages a support surface such as a floor, and an upper end which is supported adjacent a ceiling structure. One or more raceway runs 227 may be vertically mounted to the support post 361 and supported thereon via elongate mounting arms 362, each of which has one end which engages around the support post 361 and an opposite end defining mounting holes therein. The ends of arms 362 opposite post 361 are inserted between adjacent pairs of raceway covers 175 adjacent bottom walls 202 thereof and attached to spine 174 via snap connectors 232, 233, for example by punching or drilling mounting holes into spine 174 at the desired locations therealong. The lower end of the raceway run 227 is then connected to an end plate 284A of infeed chain 280 either directly with snap connectors or utilizing a connector plate 230 and snap connectors 232, 233, and the opposite end plate 284A of the infeed chain 280 can then be connected to an end of an additional raceway run 227 (not shown). To create a finished appearance, a two-piece ceiling bezel 365 may be utilized adjacent the top end of the raceway run 227 by fixing same to post 361 with an appropriate connector 366. FIG. 23 also illustrates a junction box 367 which can also be connected to post 361 so as to be positioned adjacent the upper terminal end of raceway run 227.

In the illustrated embodiment, the raceway side covers 188, spine 174, corner connectors, side covers 284, infeed spine 281, and channel members 282 are constructed of molded plastic such as ABS.

The workstation arrangement according to the invention including the worksurface 11, console 12, raceway assembly 13, and infeed chain 280 can be utilized to create a variety of freestanding work or office areas, each of which can be provided with power and communication capabilities. For example, as shown in FIG. 3, two or more worksurfaces or tables 11 can be interconnected with one or more raceway runs 227. Since the raceway runs 227 are horizontally flexible, the worksurfaces 11 can be positioned in a variety of angular positions relative to one another, if desired. Further, the infeed chain 280 according to the invention enables vertical routing of the cabling where necessary or desirable. The two workstations 11 shown in FIG. 3 can be electrically interconnected with the flexible electrical connectors or straps 84, with the connector portion 91 mounted on one end of the strap 84 being plugged into a connector portion 82 of one power block 80 and the connector portion 91 mounted on the opposite end of the strap 84 being plugged into a connector portion 82 of power block 80 of the adjacent console 12. To supply power to the interlinked consoles 12, an electrical infeed member 84A similar in construction to strap 84 and associated with a conventional power monument, for example, is plugged into a connector portion 82 of one of the power blocks 80 of the respective consoles 12 at the end thereof opposite the strap 84 as illustrated in FIG. 7. As such, a plurality of worksurfaces 11 can be electrically connected to one another and supplied with power. In a similar manner, a plurality of workstations 11 can be provided with communication capabilities for modems and the like utilizing the system disclosed in detail in the '070 application referred to above, or using regular telephone lines.

Alternatively, a single freestanding work area can be provided with power and communication cabling, for example by plugging an infeed member 84A into one end of the power block 80 of console 12 to supply power thereto and by routing a CDA 106 into console 12. The unpaired connector unit 105 defined at the end of the CDA 106 can then be plugged into an end cap (not shown) to terminate the CDA.

In addition, where it is desirable or necessary to "dead end" a raceway run 227, an end cover similar to side covers 275 of corner connector 260 may be attached to the open end of a cover member 175 by applying inward pressure to the upright edges of the cover 275 so as to deflect the mounting flanges 278 inwardly, and then releasing the side edges so that mounting flanges 278 spring outwardly and engage flanges 192A of right side cover 188 and flanges 191A of left side cover 188.

Further, the configuration of console 12 permits easy lay-in of cabling within a raceway run 227 into the console 12, for example by removing top cover 124, feeding the cabling from the raceway run 227 into a sidewardly opening port 133 of console 12 and into the interior of the console 12 for connection to power block 80 or jack 101.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A raceway arrangement comprising:

an elongate support member; and a plurality of generally tubular links mounted on said support member in end-to-end relation with one another and being open at opposite ends thereof so as to define a continuous, elongate and enclosed channel for storing cabling, each said link being defined by a pair of right and left side covers disposed in opposed relation with one another on oppositely facing sides of said support member such that said support member divides said channel into right and left channel parts for separating cabling stored within said channel, some of said side covers being pivotably connected to said support member so as to be movable between a closed position to substantially close off the corresponding said channel part and an open position to provide access to cabling within the corresponding said channel part.

2. The raceway arrangement of claim 1 wherein said support member defines upper and lower longitudinal edge portions, said right and left side covers each being hingedly connected to said lower edge portion of said support member to permit swinging movement of the respective said side covers between said open and closed positions.

3. The raceway arrangement of claim 2 wherein each said right and left side cover includes an upright side wall and top and bottom walls which are respectively cantilevered inwardly from top and bottom edges of said side wall, said bottom walls mounting thereon a downwardly projecting hook structure which cooperatively engages with an upwardly projecting hook structure defined along said lower edge portion of said support member to permit swinging movement of said side cover between said open and close positions.

4. The raceway arrangement of claim 3 wherein said top walls of said right and left side covers and said upper edge portion of said support member define thereon cooperative structures configured to fasten said top wall to said upper edge of said support member in said closed position and to permit release of said top wall from said upper edge for opening said side cover.

5. The raceway arrangement of claim 2 wherein each said right and left side cover includes an upright side wall and top and bottom walls which are respectively cantilevered inwardly from top and bottom edges of said side wall, said bottom wall of each said right and left side cover mounting thereon at least one fastening element which defines a sidewardly and inwardly opening recess therein, said lower edge portion of said support member defining a pair of hook members which project sidewardly from opposite sides of said support member and engage within the respective recesses of the opposed pair of said side covers and allow swinging movement thereof relative to said support member.

6. The raceway arrangement of claim 5 wherein each said bottom wall defines a stop thereon which cooperates with said lower edge portion of said support member to limit pivoting movement of the respective said side cover in said open position.

7. The raceway arrangement of claim 6 wherein said bottom wall of each said right and left side cover mounts thereon a pair of said fastening elements, and a plurality of elongate fingers project generally horizontally inwardly from an inner free edge of each said bottom wall between the respective said pair of fastening elements, said fingers of said opposed pair of side covers engaging one another so as to align said covers in an end-to-end manner with one another on said support member, and each said finger defining thereon a said stop in the form of an upwardly facing surface which engages with a downwardly facing surface of a said hook member located on the opposite side of said support member from the respective said side cover to limit movement thereof in said open position.

8. The raceway arrangement of claim 3 wherein said top walls of said right and left side covers terminate in respective free inner edges which are opposed to one another and an upwardly projecting hook structure is disposed adjacent each said inner free edge, each said upwardly projecting hook structure cooperating with a downwardly projecting hook structure defined along said upper edge portion of said support member, and each said top wall being flexible downwardly so as to disengage said hook structure thereof with the respective said hook structure of said support member and permit swinging movement of the respective said side cover into said open position.

9. The raceway arrangement of claim 1 wherein said support member is horizontally flexible to permit selective horizontal bending of said raceway arrangement.

10. The raceway arrangement of claim 9 wherein each adjacent pair of said links are slightly sidewardly spaced from one another in the longitudinal direction of said raceway arrangement such that a gap is defined therebetween, each said right and left side cover including a generally upright side wall defining a pair of terminal vertical end edges, one said terminal end edge of each said side cover mounting thereon a vertically elongate flange which projects in the longitudinal direction of said raceway arrangement so as to traverse the respective said gap between the adjacent pair of said links, said flanges being hingedly fastened to the respective said end edge to permit pivoting movement thereof during horizontal bending of said raceway arrangement.

11. The raceway arrangement of claim 1 wherein said plurality of tubular links and said support member together define an elongate raceway run which is extendible between a pair of worksurfaces to interconnect same, and said support member of said raceway run is horizontally flexible to permit selective horizontal bending thereof.

12. The raceway arrangement of claim 1 wherein said plurality of tubular links and said support member together define an elongate raceway segment and a plurality of said raceway segments are arranged in conjunction with at least one worksurface to define at least one work area, said support members of the respective said raceway segments being horizontally flexible to permit selective positioning of the worksurface, said raceway arrangement further including a vertically flexible infeed structure connected to a free end of at least one of said raceway segments to permit infeed of cabling from one of a wall, ceiling and a floor.

13. The raceway arrangement of claim 12 wherein said raceway arrangement further includes a corner connector for interconnection of a pair of said raceway segments in a 90 degree configuration relative to one another, said corner connector defining thereon a pair of mounting elements each of which are fixed to a terminal end of said support member of a respective said raceway segment.

14. The raceway arrangement of claim 1 wherein said plurality of tubular links and said support member together define a first raceway chain for storing cabling associated with at least one worksurface, said raceway arrangement further including a second raceway chain which is fastened to a free end of said first raceway chain, and said first and second raceway chains being respectively horizontally and vertically flexible to permit selective positioning of the worksurface associated with said arrangement.

15. The raceway arrangement of claim 14 wherein said second raceway chain includes an elongate and vertically flexible diaphragm defined by a plurality of generally upright plate-like members and an elongate support structure interconnecting said plate-like members so that same are spaced from one another in the elongate direction of said second raceway chain, upper and lower elongate connector members extending along and interconnecting respective upper and lower edges of said plate-like members, and a plurality of tubular covers supported on said diaphragm in an end-to-end manner with one another so as to define an enclosed elongate conduit for storing cabling therein.

16. The raceway arrangement of claim 1 wherein said plurality of tubular links and said support member together define an elongate raceway segment and a plurality of said raceway segments are arranged in conjunction with at least one worksurface to define at least one work area, said support members of the respective said raceway segments being horizontally flexible to permit selective positioning of the worksurface, and at least a pair of said raceway segments being joined in an end-to-end manner with one another by a connector which interconnects ends of the respective support elements of said pair of raceway segments.

17. A raceway for routing cabling to and from a workstation, said raceway comprising:

an elongate spine; and a plurality of hollow cover members each defined by vertically spaced top and bottom walls and a pair of horizontally spaced side walls, said cover members being open at both ends and supported on said spine in an end-to-end manner so as to define a continuous and enclosed elongate conduit for storing cabling therein.

18. The raceway of claim 17 wherein said spine comprises a continuous elongate structure which divides said conduit into first and second conduit portions for separating cabling stored therewithin.

19. The raceway of claim 17 wherein said cover members each have a two-part structure including right and left cover halves disposed in opposed relation with one another on opposite sides of said spine with said spine dividing said conduit into right and left conduit portions for separating cabling stored therewithin, each said cover half being supported solely by said spine.

20. The raceway of claim 19 wherein each said cover half has upper and lower fastening members which cooperate with respective upper and lower longitudinal edge portions of said spine to permit pivoting movement of each said cover half relative to said spine into an open position to access cabling stored within the respective said conduit portion.

21. A raceway arrangement for storing cabling, said arrangement comprising:

an elongate and vertically flexible diaphragm including a plurality of generally upright plate-like members and an elongate support structure interconnecting said plate-like members in a spaced-apart manner from one another and extending generally centrally between and substantially parallel to upper and lower edges thereof, and upper and lower elongate connector members extending along and interconnecting the respective upper and lower edges of said plate-like members; and a plurality of tubular covers supported on said diaphragm in an end-to-end manner with one another so as to define an enclosed elongate conduit for storing cabling therein, said covers being mounted on said diaphragm such that same extends generally centrally along said conduit and divides same into first and second channel parts for separating cabling stored within said channel.

22. The raceway arrangement of claim 21 wherein each said plate-like member defines a pair of generally upright end edges each having a convex configuration, the opposed and adjacent end edges of the respective pairs of adjacent plate-like members having reverse convex curvatures so as to permit vertical flexing of said diaphragm.

23. The raceway arrangement of claim 22 wherein each said plate-like member defines upper and lower edges which extend transversely between the respective said end edges thereof, said upper and lower edges defining respective upper and lower rod-like connector elements, said upper and lower connector members of said diaphragm including respective elongate tubular portions defining respective downwardly and upwardly opening channels therein, said upper and lower rod-like connector elements engaging within the respective said downwardly and upwardly opening channels and being slidable longitudinally therein during vertical flexing of said diaphragm.

24. The raceway arrangement of claim 22 wherein each said cover includes a pair of generally upright side walls and top and bottom walls extending transversely therebetween, each said side wall defining a pair of generally upright terminal edges each having convex configuration, the opposed and adjacent terminal edges of the respective pairs of adjacent covers having reverse convex curvatures so as to permit vertical flexing of said diaphragm.

25. The raceway arrangement of claim 21 wherein each said cover includes a pair of cover halves which are disposed in opposed relation with one another on opposite sides of said diaphragm, each said cover half being defined by a generally upright side wall and top and bottom walls which are cantilevered inwardly from upper and lower edges of the respective said side wall, said top and bottom walls of said cover halves each mounting thereon a fastening element, said fastening elements of said top and bottom walls respectively cooperating with said upper and lower connector members to mount said cover halves on said diaphragm.

26. The raceway arrangement of claim 25 wherein said fastening elements permit movement of the respective said cover halves into open positions to provide access to cabling stored within the corresponding said channel part.

27. A raceway for routing cabling comprising:

an elongate and continuous support element having a pair of opposite ends respectively supported by a pair of horizontally spaced-apart mounting structures such that the support element is disposed in a suspended manner between said ends thereof; and a tubular cover member removably mounted on said support element and together therewith defining an enclosed channel for accommodating cabling, said cover member having a wall portion which is flexible to allow access to cabling disposed within said channel.

28. The raceway of claim 27 wherein a plurality of said tubular cover members are removably mounted on said support element in end-to-end relation with one another and said channels of the respective cover members together define a continuous cable channel which extends longitudinally along said support element.

29. The raceway of claim 27 wherein said support element defines upper and lower generally parallel and longitudinally extending edges, and said cover member is removably engaged with said support element along said upper and lower edges thereof.

30. The raceway of claim 29 wherein said cover member is defined by top and bottom generally horizontally oriented walls which are interconnected to one another by a generally vertically oriented side wall, said top and bottom walls defining respective mounting structures which cooperatively engage with respective mounting elements defined on said upper and lower edges of said support element.

31. The raceway of claim 30 wherein said top wall comprises said flexible wall portion, and downward flexing of said top wall disengages said mounting structure thereof from said mounting element of said upper edge to permit access to cabling disposed within the respective channel.

32. The raceway of claim 31 wherein said mounting structure of said bottom wall and said mounting element of said lower edge together define a hinge arrangement such that when said mounting element of said upper edge and said mounting structure of said top wall are disengaged from one another, said cover member is pivotable downwardly relative to said support element to provide access to cabling disposed within the respective channel.

33. The raceway of claim 27 wherein said support element extends through a generally central region of said cover member such that a pair of said channels are defined on opposite sides of said support element.

34. A raceway arrangement comprising:

an elongate support structure having oppositely facing first and second sides; and first and second pluralities of cover elements respectively supported on said first and second sides of said support structure, each said cover element having a wall structure which defines a channel part, said first plurality of cover elements on said first side of said support structure and said second plurality of cover elements on said second side of said support structure being disposed in adjacent end-to-end relationship with one another such that the respective channel parts on said first side of said support structure together define an elongate and continuous first channel and the respective channel parts on said second side of said support structure together define an elongate and continuous second channel, wherein said first and second channels disposed on said first and second sides of said support structure are for storing cabling therein.

35. The raceway arrangement of claim 34 wherein some of said cover elements of said first and second plurality of cover elements are hingedly connected to said support structure to permit access to cabling disposed within the respective first and second channels.

36. The raceway arrangement of claim 34 wherein said support structure is generally vertically oriented and is flexible in the horizontal direction to permit horizontal bending of said raceway arrangement at selected locations therealong.

37. The raceway arrangement of claim 34 wherein each said cover element of said first plurality of cover elements is opposed to and horizontally aligned with a said cover element of said second plurality of cover elements.

38. A raceway assembly comprising:

a generally vertically oriented and elongate membrane-like support member supported at opposite ends thereof by a pair of horizontally spaced mounting structures; and a plurality of cable accommodating elements mounted on said support member and arranged in series with one another therealong, each said cable accommodating element defining a channel for storing cabling, said channels of the respective cable accommodating elements being generally aligned with one another along said support member so as to define a continuous conduit along said support member for storing cabling therein, and said support member being flexible in the horizontal direction to allow selective horizontal bending of said raceway arrangement.

39. The raceway assembly of claim 38 wherein said support member defines a portion of each of said channels together with the respective cable accommodating element.

40. The raceway assembly of claim 38 wherein each of cable accommodating elements has a hollow tubular structure and said support member extends generally centrally through each said cable accommodating element such that a pair of said channels are defined on opposite sides of said support member and a pair of said conduits extend along opposite sides of said support member for routing cabling therealong.

41. The raceway assembly of claim 38 wherein at least some of said cable accommodating elements are hingedly mounted to said support member such that each of the respective cable accommodating elements are swingably movable relative to said support member between a closed position and an open position to permit access to cabling disposed within the respective channel.

* * * * *